US011087596B2

(12) United States Patent
Nelson et al.

(10) Patent No.: US 11,087,596 B2
(45) Date of Patent: Aug. 10, 2021

(54) GAMING SYSTEMS, DEVICES, AND METHODS FOR COMPETITIVE REAL-TIME SPORTS WAGERING

(71) Applicant: IGT, Las Vegas, NV (US)

(72) Inventors: Dwayne Nelson, Las Vegas, NV (US); Cameron Filipour, Las Vegas, NV (US)

(73) Assignee: IGT, Las Vegas, NV (US)

( * ) Notice: Subject to any disclaimer, the term of this patent is extended or adjusted under 35 U.S.C. 154(b) by 271 days.

(21) Appl. No.: 16/406,671

(22) Filed: May 8, 2019

(65) Prior Publication Data

US 2020/0357246 A1 Nov. 12, 2020

(51) Int. Cl.
*G07F 17/32* (2006.01)

(52) U.S. Cl.
CPC ..... *G07F 17/3288* (2013.01); *G07F 17/323* (2013.01); *G07F 17/3251* (2013.01); *G07F 17/3258* (2013.01); *G07F 17/3276* (2013.01)

(58) Field of Classification Search
CPC ..... G07F 17/3288; G07F 17/323; G07F 17/3251; G07F 17/3258; G07F 17/3276; G06Q 50/34; A63F 13/816; A63F 13/828; A63F 2300/8052
USPC ..... 700/90–91
See application file for complete search history.

(56) References Cited

U.S. PATENT DOCUMENTS 4,093,223 A * 6/1978 Wilke ..... A63F 3/00028 463/31
4,322,612 A * 3/1982 Lange ..... G06Q 50/34 463/28
4,527,798 A * 7/1985 Siekierski ..... G06F 7/588 463/17
4,918,603 A * 4/1990 Hughes ..... G09B 19/00 463/4
4,977,503 A * 12/1990 Rudnick ..... G06F 15/0283 273/461
5,018,736 A * 5/1991 Pearson ..... A63F 3/081 463/29
5,263,723 A * 11/1993 Pearson ..... A63F 3/081 379/92.03
5,276,312 A * 1/1994 McCarthy ..... A63F 3/081 235/380
5,283,734 A * 2/1994 Von Kohorn ..... A63F 13/12 463/17

(Continued)

*Primary Examiner* — Omkar A Deodhar
*Assistant Examiner* — Matthew D Hoel
(74) *Attorney, Agent, or Firm* — Sheridan Ross P.C.

(57) ABSTRACT

The present disclosure relates generally to systems and methods that provide real-time head-to-head sports wagering between players of gaming devices. Using a gaming device, a player initiates a wagering invitation message including an invitation to wager on an event associated with a competitive sporting contest. The invitation to wager defines an outcome associated with the event and an amount for the wager. The other player, from their own gaming device, and upon receiving information about the invitation to wager, can accept, decline, or propose a modification to the invitation to wager. The players can exchange communications between an interface of their gaming devices about potential wagers, existing wagers, or past wagers. Aspects of the present disclosure provide an enhanced social experience in head-to-head competitive sports wagering from a gaming device.

20 Claims, 7 Drawing Sheets

(56) References Cited

U.S. PATENT DOCUMENTS 5,398,938 A * 3/1995 Money ..... A63F 1/04 273/239
5,489,096 A * 2/1996 Aron ..... G07C 15/005 273/138.1
5,564,701 A * 10/1996 Dettor ..... A63F 3/00157 273/256
5,575,474 A * 11/1996 Rossides ..... G06Q 50/34 463/26
5,593,349 A * 1/1997 Miguel ..... F41J 3/00 463/30
5,636,920 A * 6/1997 Shur ..... G06Q 10/06 700/91
5,713,793 A * 2/1998 Holte ..... A63F 3/081 463/1
5,769,714 A * 6/1998 Wiener ..... A63F 13/005 463/3
5,810,360 A * 9/1998 Srichayaporn ..... A63F 3/00157 273/292
5,842,921 A * 12/1998 Mindes ..... G06Q 50/34 463/16
5,846,132 A * 12/1998 Junkin ..... A63F 3/081 463/42
5,860,862 A * 1/1999 Junkin ..... G06Q 10/107 463/40
5,895,048 A * 4/1999 Smith, Jr. ..... A63F 1/00 273/293
5,898,762 A * 4/1999 Katz ..... H04Q 3/002 379/93.12
5,971,854 A * 10/1999 Pearson ..... A63F 3/081 463/41
6,001,016 A * 12/1999 Walker ..... G07F 17/32 463/20
6,015,344 A * 1/2000 Kelly ..... A63F 3/081 463/16
6,104,815 A * 8/2000 Alcorn ..... A63F 13/12 380/251
6,110,041 A * 8/2000 Walker ..... G07F 17/32 273/139
6,112,128 A * 8/2000 Steinmetz ..... A63F 3/081 273/247
6,126,543 A * 10/2000 Friedman ..... A63F 3/00157 273/139
6,135,881 A * 10/2000 Abbott ..... A63F 13/12 463/3
6,152,821 A * 11/2000 Nakagawa ..... A63F 13/10 463/4
6,155,924 A * 12/2000 Nakagawa ..... A63F 13/10 463/4
6,193,610 B1 * 2/2001 Junkin ..... G06Q 10/107 463/40
6,236,900 B1 * 5/2001 Geiger ..... G06Q 50/34 463/16
6,292,706 B1 * 9/2001 Birch ..... A63F 13/12 700/91
6,347,086 B1 * 2/2002 Strachan ..... G06Q 50/34 370/389
6,371,855 B1 * 4/2002 Gavriloff ..... A63F 13/12 463/42
6,406,371 B1 * 6/2002 Baba ..... A63F 13/12 463/42
6,527,270 B2 * 3/2003 Maksymec ..... G06Q 50/34 273/138.1
6,597,960 B2 * 7/2003 Spector ..... A63B 71/06 273/440
6,645,068 B1 * 11/2003 Kelly ..... G06Q 20/04 463/25
6,669,565 B2 * 12/2003 Liegey ..... A63F 3/081 463/1
6,688,978 B1 * 2/2004 Herman ..... A63F 3/081 463/25
6,695,701 B2 * 2/2004 Aronson ..... G07F 17/32 463/25
6,775,580 B2 * 8/2004 Jira ..... A63F 9/24 463/1
6,837,789 B2 * 1/2005 Garahi ..... G06Q 50/34 463/29
6,837,791 B1 * 1/2005 McNutt ..... G06Q 50/34 463/25
6,910,965 B2 * 6/2005 Downes ..... G07F 17/32 463/25
6,939,137 B1 * 9/2005 Colaio ..... G06Q 20/10 434/107
7,001,279 B1 * 2/2006 Barber ..... H04N 21/4781 463/42
7,275,990 B2 * 10/2007 Walker ..... G06Q 30/0209 463/25
7,351,150 B2 * 4/2008 Sanchez ..... A63F 13/86 463/42
7,548,242 B1 * 6/2009 Hughes ..... A63F 13/537 345/473
7,614,944 B1 * 11/2009 Hughes ..... A63F 13/12 463/4
7,690,991 B2 * 4/2010 Black ..... G07F 17/3288 463/26
7,699,701 B2 * 4/2010 Corbo ..... G07F 17/3244 463/25
7,988,560 B1 * 8/2011 Heller ..... A63F 9/24 463/42
8,099,182 B1 * 1/2012 Kasten ..... A63F 13/65 700/91
8,147,334 B2 4/2012 Gatto et al.
8,176,518 B1 * 5/2012 Junkin ..... A63F 13/63 725/61
8,340,794 B1 * 12/2012 Trdinich ..... A63F 13/46 700/91
8,366,551 B2 * 2/2013 Thomas ..... A63F 13/828 463/42
8,460,078 B2 * 6/2013 Moore ..... A63F 13/35 463/9
8,509,929 B1 * 8/2013 Hughes ..... A63F 13/828 700/91
8,538,563 B1 * 9/2013 Barber ..... G07F 17/3288 700/91
8,606,380 B2 * 12/2013 Trdinich ..... A63F 13/828 700/92
8,622,797 B2 * 1/2014 Noonan ..... A63F 13/828 463/9
8,684,827 B2 * 4/2014 Asher ..... G06Q 20/1085 463/25
8,764,566 B2 7/2014 Miltenberger et al.
8,851,998 B2 * 10/2014 Pawson ..... A63F 13/828 463/42
8,888,584 B2 * 11/2014 Cohen ..... A63F 13/828 463/25
9,870,674 B2 1/2018 Hayon
2001/0019965 A1 * 9/2001 Ochi ..... G07F 17/3288 463/25
2001/0036853 A1 * 11/2001 Thomas ..... G06Q 50/34 463/17
2002/0013176 A1 * 1/2002 Yoshimi ..... G07F 17/3227 463/42
2002/0068633 A1 * 6/2002 Schlaifer ..... G07F 17/3288 463/43
2002/0107073 A1 * 8/2002 Binney ..... A63F 13/828 463/42
2003/0054885 A1 * 3/2003 Pinto ..... A63F 13/79 463/42
2003/0096651 A1 * 5/2003 Black ..... G07F 17/3279 463/42
2003/0199315 A1 * 10/2003 Downes P.E. ..... G07F 17/3288 463/28
2003/0220143 A1 * 11/2003 Shteyn ..... A63F 13/792 463/42
2006/0252476 A1 * 11/2006 Bahou ..... A63F 13/12 463/4
2007/0021167 A1 * 1/2007 Ma ..... A63F 13/10 463/4

(56) References Cited

U.S. PATENT DOCUMENTS

| | | | | |
|---|---|---|---|---|
| 2008/0039210 | A1* | 2/2008 | Junkin | A63F 13/61<br>463/42 |
| 2012/0231890 | A1* | 9/2012 | Junkin | H04N 21/4781<br>463/42 |
| 2013/0303291 | A1* | 11/2013 | Hughes | A63F 13/12<br>463/42 |

* cited by examiner

GAMING SYSTEMS, DEVICES, AND METHODS FOR COMPETITIVE REAL-TIME SPORTS WAGERING

BACKGROUND

The present disclosure is generally directed to wagering systems and, in particular, toward wagering systems that enable competitive real-time wagering.

Sports betting generally includes wagering on a chosen outcome of an event in a competitive sport. Based on the odds associated with the outcome of the event, a payout for the wager may be established. The odds are closely tied to the likelihood, or probability, of the outcome occurring. As the likelihood of the outcome occurring increases, the odds and the payout may decrease, and vice versa. In any event, bettors traditionally wager against the odds set by a sportsbook or designated odds maker.

BRIEF SUMMARY

In certain embodiments, the present disclosure relates to a system, device, and method that provide real-time head-to-head sports wagering between players in a competitive wagering system. In some embodiments, a system is provided, comprising: a communications interface that enables communications with a first gaming device and a second gaming device; a processor coupled to the communications interface; and a memory coupled with and readable by the processor and storing therein instructions that, when executed by the processor, cause the processor to: receive, via the communications interface and from the first gaming device, a wagering invitation message comprising an invitation to wager on an event associated with a competitive contest, wherein the invitation to wager defines an outcome associated with the event and an amount for the wager; send, via the communications interface, information from the wagering invitation message to the second gaming device; receive, via the communications interface and from the second gaming device, a wagering acceptance message comprising an acceptance of the invitation to wager on the event; determine, based on whether the outcome associated with the event occurred, a winner of the wager; and send, via the communications interface, an award notification message to the first gaming device and the second gaming device that provides an indication of the winner of the wager.

In some embodiments, a method for providing head-to-head wagering between gaming devices is provided, comprising: receiving, via a communications interface and from a first gaming device, a wagering invitation message comprising an invitation to wager on an event associated with a competitive contest, wherein the invitation to wager defines an outcome associated with the event and an amount for the wager; sending, via the communications interface, information from the wagering invitation message to a second gaming device; receiving, via the communications interface and from the second gaming device, a wagering acceptance message comprising an acceptance of the invitation to wager on the event; determining, via a processor and based on whether the outcome associated with the event occurred, a winner of the wager; and sending, via the communications interface, an award notification message to the first gaming device and the second gaming device that provides an indication of the winner of the wager.

In some embodiments, a gaming device is provided, comprising: a display device; a communications interface; a processor coupled to the display device and the communications interface; and a memory coupled with and readable by the processor and storing therein instructions that, when executed by the processor, cause the processor to: render a competitive contest to a first portion of the display device; receive, via the communications interface, a wagering invitation message created by a first gaming device comprising an invitation to wager on an event associated with a competitive contest against the first gaming device; render information from the wagering invitation message to a second portion of the display device, the information defining a wager of whether an outcome associated with the event will occur during the competitive contest and an amount for the wager; receive input from a user interacting with the gaming device accepting the wager of whether the outcome associated with the event will occur during the competitive contest and the amount for the wager; and send, via the communications interface, a signal comprising information defining acceptance of the wager on behalf of the user along with a time at which the input was received from the user.

Additional features and advantages are described herein and will be apparent from the following Description and the figures.

DETAILED DESCRIPTION

Figure 1:
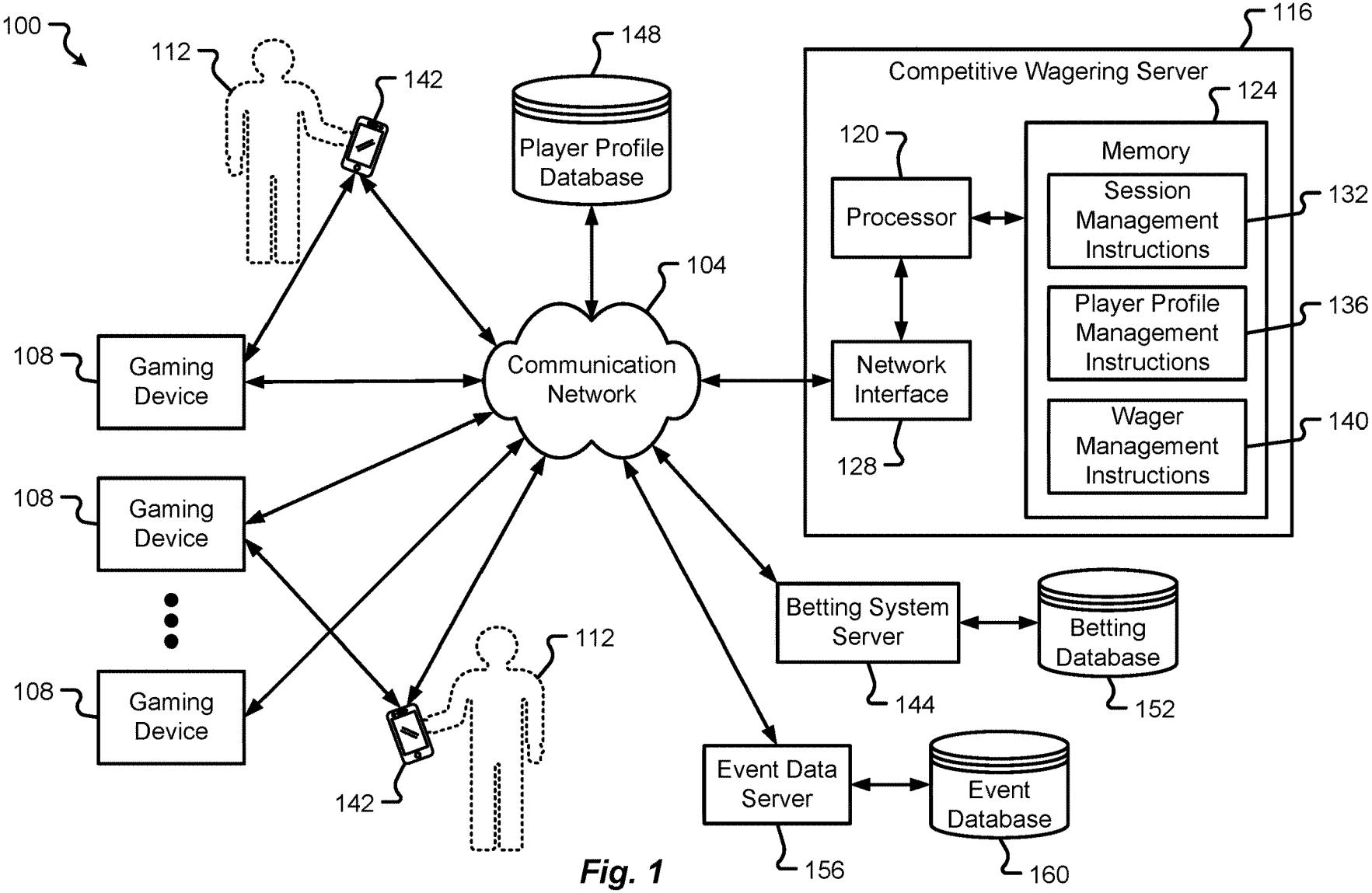
FIG. 1 is a block diagram of a competitive wagering system accordance with embodiments of the present disclosure.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices. Moreover, an Electronic Gaming Machine (EGM) as used herein refers to any suitable electronic gaming machine which enables a player to play a game (including but not limited to a game of chance, a game of skill, and/or a game of partial skill) to potentially win one or more awards, wherein the EGM comprises, but is not limited to: a slot machine, a video poker machine, a video lottery terminal, a terminal associated with an electronic table game, a video keno machine, a video bingo machine located on a casino floor, a sports betting terminal, or a kiosk, such as a sports betting kiosk.

In various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the communication network includes a WAN, the gaming system includes a central server, central controller, or remote host and an EGM (or personal gaming device) each located in a different gaming establishment in a same geographic area, such as a same city or a same state. Gaming systems in which the communication network includes a WAN are substantially identical to gaming systems in which the communication network includes a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique player name and password combination assigned to the player. The central server, central controller, or remote host may, however, identify the player in any other suitable manner, such as by validating a player tracking identification number associated with the player; by reading a player tracking card or other smart card inserted into a card reader; by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

Embodiments of the present disclosure will be described in connection with a competitive wagering system having one or multiple gaming devices that enable gaming and wagering activity. The gaming devices may comprise any computing device, personal gaming device, mobile phone, mobile devices, EGM, or collection of computing devices that may be used to facilitate player engagement with a competitive wagering system.

Embodiments of the present disclosure may provide the ability for one player to make sports bets against another player from a gaming device. The in-play, or real-time, sports betting provided allows two or more players to bet on individual plays, quarters, innings, events, etc., against one another in real time. Play-by-play each player can challenge the other player, via a sports wager, as to the outcome of the next play. Players can accept or decline each offer, or invitation, to wager. In some embodiments, the players may be part of a communications session established between gaming devices that enables text, voice, or similar chat technologies to communicate with one another. The competitive wagering system described herein provides various methods to pair the players against each other. In some embodiments a casino or sports betting system may take a percentage of the amount bet.

In some embodiments, players can wager against one another without requiring the calculation of odds associated with the in-play wagers. Calculating the odds, especially in real time, of in-play wagers requires significant processing capabilities, bandwidth, and time. Due to the fast-paced nature of in-play wagering, these calculations cannot always be provided in time (e.g., before the event wagered on occurs, etc.) and, as such, a negative wagering experience may result for the players. Among other things, the present disclosure allows players to set their own terms (e.g., bet amounts, odds, timeframes, etc.) and wager against one another without requiring the odds to be calculated or otherwise provided. Wagering against one another, rather than against the odds or a sportsbook, creates an emotional and social experience for the players.

In addition to providing the ability to wager against one another, the players participating in the head-to-head competitive wagering may be matched based on a number of factors. For instance, players may be matched with one another, or in groups, based on their similarities, wagering behavior, teams supported, contacts, historical wagering activity, and/or combinations thereof. Once matched, players may participate in a communications session where they can exchange messages, voice chat, challenges, banter, celebrations, congratulations, commiserations, and/or the like. In some embodiments, the messages may be personal messages (e.g., messages exchanged between the players engaged in a competitive wagering session, etc.) regarding the wager made, an outcome of the wager, further challenges or wager invitations, banter, comments, and/or the like. Combining this intelligent matching of players with the ability to communicate and wager against one another in head-to-head competitive wagering provides a rich social experience.

Embodiments of the present disclosure may apply to sports wagering on mobile devices, personal computers, kiosks, EGMs, betting terminals, or other gaming devices. Each player may have a player account that maintains a player account balance in a memory. Players may be able to make wagers that are recorded with the competitive wagering system. The competitive wagering system and/or a betting application (e.g., running on a gaming device associated with the player) may store an electronic record in local memory that describes a player's favorite team(s). In some embodiments, the competitive wagering system and/or the betting application may store an electronic record in local memory that describes on which each player is wagering, or has wagered.

It is an aspect of the present disclosure that the competitive wagering system encourages real-time (also called in-play or in-game) sports betting. Play-by-play betting is exciting and more emotional and social that traditional sports betting. Emotional betting is better for a sportsbook when compared to the calculated professional sports bettor. In some embodiments, each player can use a sports wagering terminal, mobile device, personal computer, or other gaming device to view and/or access the competitive wagering system. The competitive wagering system may provide possible wagers, optional live video of at least some of the events, and may also allow a player to learn information about other players through a user interface of the competitive wagering application rendered to a display of the gaming device. In some embodiments, the player can optionally view the live sporting events on a separate device such as a television while participating in the competitive wagering provided via the competitive wagering system.

As provided herein, the players may wager on individual outcomes associated with a live sports game. The players may watch the game, live, on the gaming device or on a separate display device, such as a television. In-play wagering allows the players to bet on individual events in the game such as the next pitch in baseball or next down in football. As provided above, getting official odds correct or in a timely manner for the in-play events is very difficult, but it can be done using historical information or by entering the players in a pari-mutuel bet on each event. One problem associated with conventional wagering arises from people wagering on events that are too easy to know so everyone bets on the single side of the outcome. For example, if a football team is on the 10-yard line it is very likely that the team will make a field goal so everyone places bets on the field goal being successful. However, a sportsbook needs a number of players to bet against this outcome to be profitable.

In contrast to the problems associated with conventional wagering, the present disclosure allows at least two players to bet against one another eliminating the need to officially compute the odds prior to the event occurring. Further, the head-to-head competitive wagering described herein does not require a balance of players betting on different outcomes to be profitable. Rather, in the embodiments described herein, a casino or sportsbook can simply take a percentage of the bet made by the players. For the sake of example, Player A may wager against Player B who the next sports team member will be to score. In this example, the players may bet $50. If Player A wins, and is paid $49, the casino or sportsbook may keep the remaining $1 of the $50 bet. Among other things, this feature of the competitive wagering system provides a guaranteed profit for the casino or sportsbook in all scenarios, except in the rare event of a push. However, in the event of a push, players may be encouraged to double their bets, or parlay their bets into another wagering or gambling opportunity.

In some embodiments, the players may be betting against one another but may always be betting for the same team. For example, Player A may always be betting for the Angels and against the Dodgers when the Dodgers and Angels are playing. In other embodiments, the players may bet on individual events which may not match their desires for the overall outcome of a game, or even match which team they are a fan of. For example, Player A might want the Angels to win, but will bet that the Angels do not score this inning.

In some embodiments, the players bet against each other during while matched in a competitive wagering session. At the end of a time period associated with the game (e.g., end of the quarter, period, or half, etc.), at the end of the competitive wagering session, or after a certain amount of time has elapsed, a winner may be selected based on which player in the competitive wagering session made the most correct or winning wagers. For example, Player A and Player B enter the competitive wagering session. Both players may bet $50.00. During the competitive wagering session they bet against each other on each play. When a player wins the play that player may get one or more win points. At the end of the competitive wagering session Player A may have 32 win points while Player B may have 26 win points. In this example, Player A is the winner because Player A has more win points than Player B.

When a player challenges another player in a competitive wagering session by sending a wagering invitation, the other player can accept the bet, deny the bet, or offer an alternative bet (e.g., propose a modification to the wager, etc.). For example, Player A may bet Player B that the next play will be a throwing pass for more than 5 yards with a bet amount of $20. Player B may propose a modification (e.g., counteroffers) that the next play will be more than 7 yards but may limit the bet amount to $10. Player A can accept or reject the proposed modification to the wager.

In some embodiments, wagering invitations may include custom offers created by the players and/or predetermined offers to wager prepared by the competitive wagering system and/or the sportsbook. A learning system may learn what types of offers are likely to be accepted and can be wagered within a short amount of time and push these predetermined wagering opportunities out to players for acceptance or modification.

One goal of the embodiments described herein is to encourage two or more players to enter into the matching system and participate in a competitive wagering session. Players may be able to selectively opt-in to this feature. In one embodiment, the competitive wagering system may match two players who are betting against each other on the game or are fans of the opposing teams playing. For example, Player A may be betting on the Angels and Player B may be betting on the Dodgers in a game between the Angels and Dodgers. The competitive wagering system may pair, or match, Player A and Player B together to bet in real time against one another. Player A may bet that the Angels will succeed in plays (batting, scoring, etc.) and Player B may bet against that. The system may prompt Player A, with a betting opportunity message, such as, "Would you like to bet against Player B, who is betting that the Dodgers will win this game?" Both players may accept the opportunity to be matched and are then entered into the real-time competitive wagering session with real-time communications and, optionally, real-time video feed of the Angels and Dodgers game. In some embodiments, once a player accepts a prompt by the system, a wagering invitation message may be sent from the accepting player to the opposing player (e.g., via the system).

In one embodiment, players may be able to post challenges on a social interface of the competitive wagering system. For example, Player B may challenge Angels fans by posting a message, such as, "I'll take your losing Angels bets!" for everyone to see. The interface might show statistics about Player B in addition to the challenge. For example, the user interface of a gaming device may show that Player B bets $10 per play on average and bets on 30 plays of an average game. This information may be used to help other players get correctly matched with the right opponent by avoiding mixing players with different bankrolls.

In some embodiments, a player may be allowed to search for, or provide limits on, potential matches, such as, to find other players that are willing to limit the betting to $100 per unit of time (per game, per quarter, etc.). Various filtering mechanisms may be provided to the player (e.g., via the gaming device) such as filtering by sport, team, amount wagered, average number of wagers, opposing team, etc. Such local filtering mechanisms may avoid the need to generate and transmit a database query to a remote database.

The competitive wagering system may allow players to create friends based on previous wagering experiences. For example, Player A may sit down at a sports betting terminal and see that Player B is currently betting. Player A may remember losing to Player B the previous week when the Dodgers beat the Angels. Player A really enjoyed the match against Player B because the communication was fun and their betting styles worked well against each other (similar bet amounts and betting on similar events). Today, the Dodgers may be playing the Mariners so Player A challenges Player B again on this current sports matchup. Player A bets on the Mariners against Player B.

In some embodiments, the system matches players who may be at different physical locations. Among other things, matching those who are not in proximity to one another may prevent cheating, physical violence, and/or other unsporting behavior.

In one embodiment, players are matched based on the teams they like. Player A may be registered as a fan of the Angels and Player B may be registered as a fan of the Dodgers. When the Angels play the Dodgers the competitive wagering system may match Player A and Player B together.

The communications described herein, and enabled between gaming devices in the competitive wagering system, may bring an additional level of excitement to the game. For instance, players may enjoy, bragging, gloating, or complaining. Some players may enjoy "talking trash" in a fun way that may contribute to making the overall head-to-head competitive wagering experience better.

In some embodiments the players can type or text messages to each other via the competitive wagering system. In some embodiments, the system may enable voice or chat communications between the players. In one embodiment, the players may communicate and challenge each other through the communications interface of the competitive wagering system making the wagering experience a social, as well as a gaming, interaction.

Additionally or alternatively, the players may use the user interface of the competitive wagering system application (e.g., running on the gaming device, etc.) to interact with one another. For example, a player may use the user interface to initiate a wager (e.g., by sending a wager invitation message, etc.) betting that the current athlete at bat in a baseball game will get on base, prior to the athlete getting on base or being struck out. As provided by the communications aspects described herein, the player may interact with the user interface and provide input telling the player's opponent (e.g., the other player in the competitive wagering session) that "You want to bet me on that, you know my guy is hot right now!" or send other comments, challenge communications, and observations. In one embodiment, a message board may comprise a number of betting statistics associated with each player in the competitive wagering session. In this example, a player may be able to select a "bet now" button next to one or more players in the competitive wagering session to initiate wagering.

In some embodiments, the players may identify with one or more sports teams or sport leagues. For example, a player might identify with the Los Angeles Dodgers. In this example, the player may be required to register the identification or interest in the team which is stored in a player information field of a player profile database. Continuing this example, the user interface of the competitive wagering system application rendered to a gaming device may show the Dodgers logo next to the player's name, username, or avatar.

In some embodiments, leaderboards of the players may be displayed in the application or on separate devices such as on a display at a sportsbook. The leaderboards may be curated by the competitive wagering server or other combination of components associated with the competitive wagering system. The leaderboard can rank players based on a number of factors. In one embodiment, the leaderboard may rank those players who have won the most bets on a certain team or on their favorite team. In some embodiments, the leaderboard may rank players by the number of opposing players, groups, and/or teams they have beaten in head-to-head competitive wagering.

In some embodiments, a progressive or prize can be awarded to certain players. For instance, specific players may be awarded for being loyal to a team and successfully wagering with the team to which they are loyal. In one embodiment, a player may earn an entry into a jackpot pool each time the player makes a successful wager for that player's team. In one embodiment, the player who makes the most successful wagers wins the prize. Additionally or alternatively, prizes may be awarded for second place, third place, etc. In one embodiment, a particular team may be selected, for example, based on a random event, or possibly an event in the game, and then the competitive wagering system may award a prize to the players wagering on that team.

In some embodiments, the gaming devices described herein may allow head-to-head competitive wagering and provide traditional casino and/or interactive gaming such as video poker, slots, bingo, blackjack, skill games, electronic table games (e.g., live roulette, baccarat, etc.), and keno. Embodiments of the present disclosure describe various ways of integrating head-to-head competitive wagering and casino games in a gaming device to increase the value of the gaming device, enhance the gaming experience, and offer both head-to-head competitive wagering and casino gaming in a single device.

In some embodiments, the gaming device may be configured with one or more casino games such as skill games, Poker, Slots, Keno, Bingo or Blackjack. The gaming device may also be configured to allow a player to place head-to-head competitive wagers against other players participating in a competitive wagering session. Additionally or alternatively, the players may be able to watch live sporting events, live horse racing events, live competitive contests, etc., on the gaming device.

With reference initially to FIG. 1, details of an illustrative competitive wagering system 100 will be described in accordance with at least some embodiments of the present disclosure. The components of the competitive wagering system 100, while depicted as having particular instruction sets and devices, are not necessarily limited to the examples depicted herein. Rather, a system according to embodiments of the present disclosure may include one, some, or all of the components depicted in the system 100 and does not necessarily have to include all of the components in a single device. For instance, the components of a server may be distributed amongst a plurality of servers and/or other devices (e.g., gaming devices, EGMs, mobile devices, etc.) in the system 100 without departing from the scope of the present disclosure.

The competitive wagering system 100 is shown to include a communication network 104 that interconnects and facilitates machine-to-machine communications between one or multiple gaming devices 108, a competitive wagering server 116, a betting system server 144, and an event data server 156. It should be appreciated that the communication network 104 may correspond to one or many communication networks without departing from the scope of the present disclosure. In some embodiments, the gaming devices 108 and server(s) 116, 144, 156 may be configured to communicate using various nodes or components of the communication network 104. The communication network 104 may comprise any type of known communication medium or collection of communication media and may use any type of protocols to transport messages between endpoints. The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 104 need not be limited to any one network type, and instead may be comprised of a number of different networks and/or network types. Moreover, the communication network 104 may comprise a number of different communication media such as coaxial cable, copper cable/wire, fiber-optic cable, antennas for transmitting/receiving wireless messages, and combinations thereof.

In some embodiments, the gaming devices 108 may be distributed throughout a single property or premises (e.g., a single casino floor) or the gaming devices 108 may be distributed among a plurality of different properties. In a situation where the gaming devices 108 are distributed in a single property or premises, the communication network 104 may include at least some wired connections between network nodes. As a non-limiting example, the nodes of the communication network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The gaming devices 108 may utilize the same or different types of communication protocols to connect with the communication network 104. It should also be appreciated that the gaming devices 108 may or may not present the same type of game or wagering interface to a player 112. For instance, a first gaming device 108 may correspond to a gaming machine that presents a slot game to the player 112, the second gaming device 108 may correspond to a sports betting terminal, and other gaming devices 108 may present other types of games or a plurality of different games for selection and eventual play by a player 112. It may be possible for the some of the gaming devices 108 to communicate with one another via the communication network 104. In some embodiments, one or more of the gaming devices 108 may only be configured to communicate with a centralized management server and/or the competitive wagering server 116. Although not depicted, the system 100 may include a separate server (e.g., a gaming server, etc.) or collection of servers that are responsible for managing the operation of the various gaming devices 108 in the competitive wagering system 100. It should also be appreciated that the competitive wagering server 116 may or may not be co-located with one or more gaming devices 108 in the same property or premises. Thus, one or more gaming devices 108 may communicate with the competitive wagering server 116 over a WAN, such as the Internet. In such an event, a tunneling protocol or Virtual Private Network (VPN) may be established over some of the communication network 104 to ensure that communications between a gaming device and a remotely-located server 116 are secured.

A gaming device 108 may correspond to a type of device that enables player interaction in connection with making wagers, communicating, watching live competitive contests, and/or playing games of chance. For instance, the gaming devices 108 may correspond to a type of device that enables a first player 112 to interact with a second player 112 in connection with head-to-head wagering on competitive contests. A gaming device 108 may include any type of known gaming device such as a slot machine, a table game, an electronic table game (e.g., video poker), a skill-based game, etc. The gaming device 108 can be in the form of an EGM, virtual gaming machine, video game gambling machine, etc. One particular type of gaming device 108 may include mobile devices 142 such as portable communications devices, personal computers, and/or other microprocessor-enabled devices having memory and communications interfaces. Non-limiting examples of a mobile device 142 include a cellular phone, a smartphone, a tablet, a wearable device, an augmented reality headset, a virtual reality headset, a laptop, a Personal Computer (PC), or the like. In addition to playing games and wagering on a gaming device 108, the players 112 may also be allowed to play games of chance and/or skill on respective mobile devices 142. In some embodiments, the mobile devices 142 may interact with another gaming device 108 to allow a player 112 to play games and/or engage with the competitive wagering server 116. The mobile device 142 may run an application that, among other things, enables the head-to-head wagering as described herein. As provided above, the mobile device 142 may correspond to a player's 112 personal device (e.g., a smartphone) or to a device that is issued to the player 112 during the player's visit at a particular casino. It should be appreciated that the player 112 may play games directly on their mobile device 142 and/or the mobile device 142 may be in communication with another gaming device 108 such that the mobile device 142 provides the human-to-machine interface for the player 112 to the other gaming device 108. As shown in FIG. 1, the mobile device 142 may be in communication with the communication network 104 or in direct communication (e.g., via Bluetooth, WiFi, etc.) with another gaming device 108 in the competitive wagering system 100.

The competitive wagering server 116 is further shown to include a processor 120, memory 124, and a network interface 128. These resources may enable functionality of the competitive wagering server 116 as will be described herein. For instance, the network interface 128 provides the server 116 with the ability to send and receive communication packets or the like over the communication network 104. The network interface 128 may be provided as a network interface card (NIC), a Slot Machine Interface Board (SMIB), a network port, a modem, drivers for the same, and the like. Communications between the components of the server 116 and other devices connected to the communication network 104 may all flow through the network interface 128.

The processor 120 may correspond to one or many computer processing devices. For instance, the processor 120 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 120 may be provided as a microprocessor, Central Processing Unit (CPU), or plurality of microprocessors that are configured to execute the instructions sets stored in memory 124. Upon executing the instruction sets stored in memory 124, the processor 120 enables various game management, player authentication, and wager management functions of the competitive wagering server 116.

The memory 124 may include any type of computer memory device or collection of computer memory devices. Non-limiting examples of memory 124 include Random Access Memory (RAM), Read Only Memory (ROM), flash memory, Electronically-Erasable Programmable ROM (EEPROM), Dynamic RAM (DRAM), etc. The memory 124 may be configured to store the instruction sets depicted in addition to temporarily storing data for the processor 120 to execute various types of routines or functions. Although not depicted, the memory 124 may include instructions that enable the processor 120 to store data into a player profile database 148 and/or a betting database 152 and retrieve information from the databases 148, 152. Alternatively or additionally, the player profile database 148 or data stored therein may be stored internal to the server 116 (e.g., within the memory 124 of the server 116 rather than in a separate database). Alternatively or additionally, the betting database 152 or data stored therein may be stored internal to the competitive wagering server 116 or the betting system server 144.

The illustrative instruction sets that may be stored in memory 124 include, without limitation, a session management instruction set 132, a player profile management instruction set 136, and a wager management instruction set 140. Functions of the server 116 enabled by these various instruction sets will be described in further detail herein. It should be appreciated that the instruction sets depicted in FIG. 1 may be combined (partially or completely) with other instruction sets or may be further separated into additional and different instruction sets, depending upon configuration preferences for the server 116. Said another way, the particular instruction sets depicted in FIG. 1 should not be construed as limiting embodiments described herein.

The session management instruction set 132, when executed by the processor 120, may enable the competitive wagering server 116 to manage at least one of the matching, interaction, and ranking of players 112 in competitive wagering sessions. In some embodiments, the session management instruction set 132 may determine players 112 to be matched from a pool of players 112 enrolled with the competitive wagering server 116. Players 112 participating in competitive wagering sessions may be matched by the competitive wagering server 116 and/or the gaming device 108. In some embodiments, a head-to-head competitive wagering application running on the competitive wagering server 116 and/or the gaming device 108 (e.g., a mobile device 142, etc.) may enable the matching, interaction (e.g., communications, challenges, invitations, etc.) between, and/or ranking of players 112. In other words, any matching, ranking, or player-to-player interactions associated with a competitive wagering session via the gaming devices 108 may be managed, partially or entirely, by execution of the session management instruction set 132. The session management instruction set 132 may also be configured to track a status of wager events (e.g., head-to-head competitive wagering events, competitive contest events, etc.) and whether a player 112 has placed a wager on such events. In some embodiments, when a wager event has come to completion such that wagers made on the event become payable (e.g., at the end of a sporting event when the final score of the event is determined, when an outcome of an event occurred is determined to have occurred, or not occurred, in a given time, etc.), the session management instruction set 132 may notify the player profile management instruction set 136, thereby enabling the player profile management instruction set 136 to update states and/or values of wagers, play history, etc., for the player 112.

The player profile management instruction set 136, when executed by the processor 120, may enable the competitive wagering server 116 to manage one or more data fields for a player profile, for example, stored in the player profile database 148 and/or cause a gaming device 108 to update an appropriate credit meter for the player 112 within the gaming device being played by the player 112. In some embodiments, the player profile management instruction set 136 may be configured to create one or more player profiles and associated data structures within the player profile database 148. A player profile, in some embodiments, may include player 112 identification information and a wager account record for the player. In some embodiments, the player profile management instruction set 136 may be responsible for managing electronic records of all players 112 within the competitive wagering system 100 or a subset of players 112 within the competitive wagering system 100. In some embodiments, the player profile management instruction set 136 may be responsible for updating a player profile to indicate that an associated player 112 is attempting to earn a bonus or jackpot based on an aggregation of events that can occur within the competitive wagering system 100. The player profile management instruction set 136 may be configured to work in synchronization with the session management instruction set 132 and/or the wager management instruction set 140 to update a player profile in response to a player 112 completing one or a plurality of events defined for a bonus or jackpot based on the aggregation of events that can occur within the competitive wagering system 100 or over a number of competitive wagering sessions.

In some embodiments, the wager management instruction set 140, when executed by the processor 120, may enable the competitive wagering server 116 to manage various bets, or wagers, made by players 112 via gaming devices 108, manage interactions between the competitive wagering server 116, the betting system server 144, and the event data server 156, determine a status of bets placed via the gaming devices 108, update the betting database 152, obtain information from the betting database 152 and the event data server 156, and determine award amounts for players 112 at the gaming devices 108. In some embodiments, the wager management instruction set 140 is configured to perform any action consistent with receiving bets placed by a player 112 at a gaming device 108, determining whether the player 112 is authorized to place the bet, and communicating with the betting system server 144. In some embodiments, the wager management instruction set 140 may be configured to generate or cause the session management instruction set 132 to generate, a synthesized credit meter for a gaming device 108. For instance, as gaming devices 108, or a mobile device 142, have their credit meters updated, the competitive wagering server 116 may update a corresponding synthesized credit meter to reflect updates at the credit meters. In some embodiments, values of credit or other events stored in credit meters of devices 108 may be mirrored in a synthesized credit meter maintained by the competitive wagering server 116.

The competitive wagering system 100 may comprise a betting system server 144 that determines wagering options and events, sets odds, and accepts bets made by players 112 at one or more gaming devices 108. The betting system server 144 may be an online sportsbook and/or racebook that is accessible across the communication network 104. Similar to the competitive wagering server 116, the betting system server 144 may comprise a processor 120, memory 124, and a network interface 128, as described above. In some embodiments, the memory 124 of the betting system server 144 may comprise different instructions than the memory 124 of the competitive wagering server 116. Upon receiving a head-to-head bet on an outcome associated with an event in a competitive contest (e.g., placed by a player 112 at a gaming device 108), the betting system server 144 may store the bet in the betting database 152. As provided above the competitive contests may include, but are in no way limited to, matches, games, races (e.g., horse races, dog races, political races, etc.), competitions, boxing events, fighting events (e.g., boxing, mixed martial arts (MMA), wrestling, judo, karate, etc.), entertainment events, organized events, shows, combinations thereof, and/or discrete betting events associated with the same. In some embodiments, the betting system server 144 may receive information from one or more gaming devices 108 regarding wagers made between players 112 of different devices 108. This information may define custom wagering invitations created by the players 112 and generated as messages by the gaming device 108. the custom wagering invitations may include, but are in no way limited to, a wager description, a bet amount, and/or timing associated with the wager. In one embodiment, the information may be extracted by the betting system server 144 and the custom wagering invitations may appear as wagering options presented to the players 112 via their respective gaming devices 108 during a competitive wagering session.

The event data server 156 may correspond to a server that tracks and records events or occurrences associated with competitive contests. These events may include, but are in no way limited to, scores, positions, plays, penalties, errors, injuries, calls, reviews, outcomes, results, times associated therewith, and/or the like. In some embodiments, these events may be automatically determined, via a processor, recognizing the occurrence of an event during a competitive contest. In one embodiment, these events may be manually recorded by one or more individuals recording information about a competitive contest and manually entering the information into one or more fields provided by an application run on, or hosted by, the event data server 156. Examples of typical events associated with a competitive contest, like American football for instance, may include instances or occurrences such as fumbles, pass completions, incomplete passes, interceptions, punts, downs made, yards gained, timeouts taken, field goals, safeties, extra points, and touchdowns, to name a few. These events may be cataloged, associated with a particular team and/or game, and stored along with a time of the event in a memory device such as event database 160. Similar to the competitive wagering server 116, the betting system server 144 may comprise a processor 120, memory 124, and a network interface 128, as described above.

Although not shown in FIG. 1, the competitive wagering system 100 may include a contest video server. The contest video server may correspond to server comprising a processor 120, memory 124, and a network interface 128, similar, if not identical, to those described in conjunction with competitive wagering system 100 above. The contest video server may be configured to host and provide live video of one or more competitive contests bet on by players 112 participating in a head-to-head competitive wagering session in the competitive wagering system 100. In some embodiments, the contest video server may be interconnected with the communication network 104 and may provide video or other live streaming content via a real-time streaming protocol (RTSP), data over cable service interface specification (DOCSIS), or other communications protocol. The contest video server may be hosted and/or operated by a multiple-system operator (MSO), such as a satellite television, internet entertainment, or cable company. In any event, embodiments of the present disclosure describe receiving video, live streams or feeds, and/or other content from the contest video server and rendering such information, at least in part, to the one or more gaming devices 108, a television, and/or some other display device.

Figure 2:
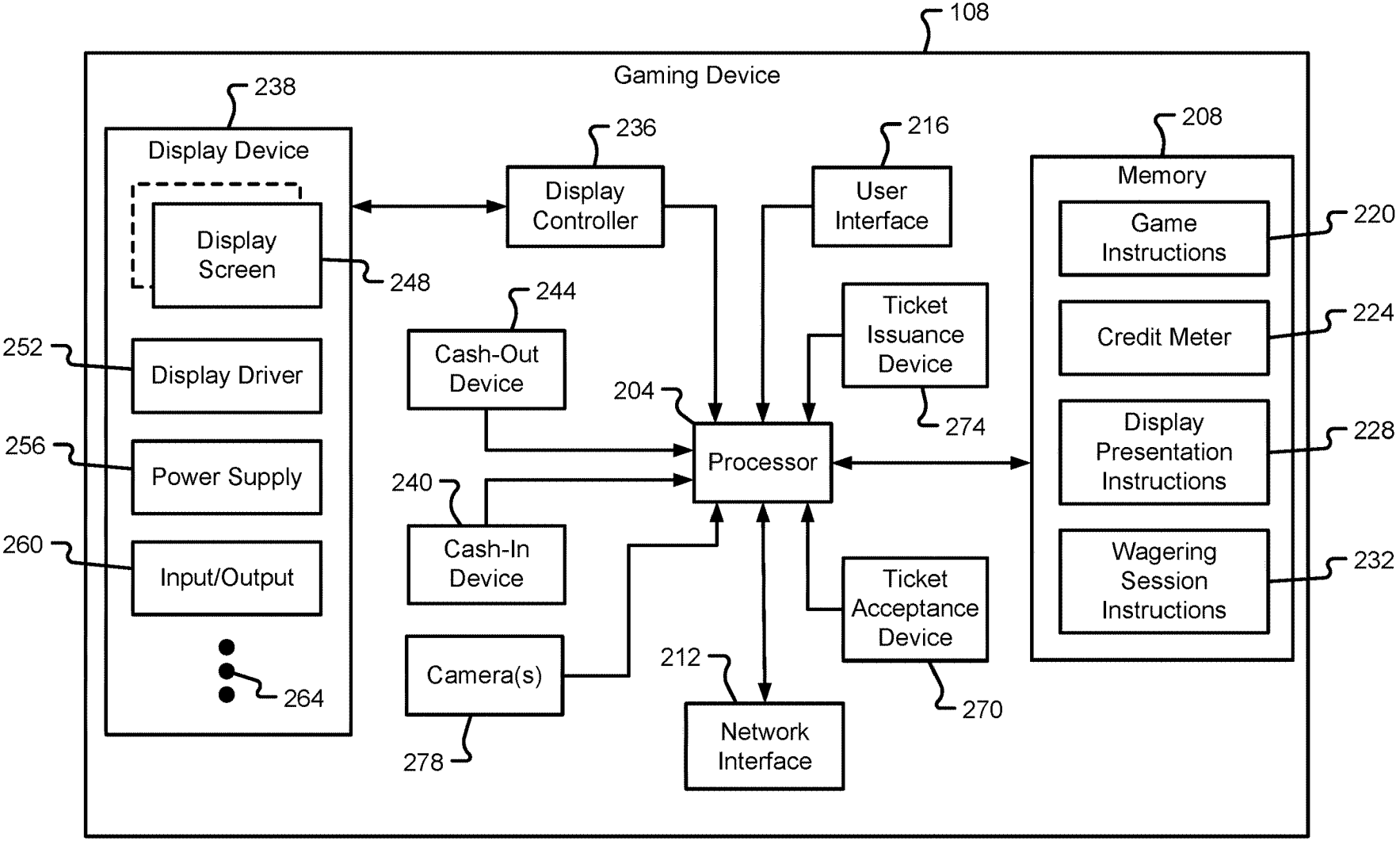
FIG. 2 is a block diagram depicting an illustrative gaming device in accordance with embodiments of the present disclosure.

With reference now to FIG. 2, additional details of a gaming device 108 will be described in accordance with at least some embodiments of the present disclosure. While depicted as a gaming device 108, it should be appreciated that some or all of the components of a single gaming device 108 may be distributed across multiple gaming devices 108 (of the same or different type) without departing from the scope of the present disclosure.

The gaming device 108 is depicted to include a processor 204, memory 208, a network interface 212, a user interface 216, a display controller 236, a display device 238, a cash-in device 240, a cash-out device 244, a ticket acceptance device 270, a ticket issuance device 274, and one or more cameras 278. In some embodiments, the processor 204 may be similar or identical to the processor 120. In other words, the processor 204 may correspond to one or many microprocessors, CPUs, microcontrollers, or the like. The processor 204 may be configured to execute one or more instruction sets stored in memory 208.

The network interface 212 may also be similar or identical to network interface 128. The nature of the network interface 212, however, may depend upon whether the network interface 212 is provided in a gaming device 108 or mobile device 142. Examples of a suitable network interface 212 include, without limitation, an Ethernet port, a USB port, an RS-232 port, an RS-485 port, a NIC, an antenna, a driver circuit, a modulator/demodulator, etc. The network interface 212 may include one or multiple different network interfaces depending upon whether the gaming device 108 is connecting to a single communication network 104 or multiple different types of communication networks 104. For instance, the gaming device 108 may be provided with both a wired network interface and a wireless network interface without departing from the scope of the present disclosure. In some embodiments, the network interface 212 may include different communications ports that interconnect with various input/output lines. For example, a first communications port may provide an interconnection (e.g., via at least one Ethernet, RJ-11, RJ-45, or other communications port) between the network interface 212 and the competitive wagering server 116 or other servers 144, 156 in the competitive wagering system 100. Continuing this example, a second communications port of the network interface 212 may provide an interconnection between the network interface 212 and the contest video server. In this manner, the gaming device 108 may allow for the transfer of information from one or more of the servers 116, 144, 156 in the competitive wagering system 100, while simultaneously receiving at least one video feed from the contest video server.

The user interface 216 may correspond to any type of input and/or output device that enables the player 112 to interact with the gaming device 108. As can be appreciated, the nature of the user interface 216 may depend upon the nature of the gaming device 108. For instance, if the gaming device 108 includes a mechanical reel slot machine game, then the user interface 216 may include one or more mechanical reels, or virtual rendered reels, with symbols provided thereon, one or more lights or LED displays, one or more depressible buttons, a lever or "one armed bandit handle," a speaker, or combinations thereof. If the gaming device 108 is a digital or mobile device 142, then the user interface 316 may include one or more touch-sensitive displays, LED/LCD display screens, buttons, switches, etc.

The memory 208 may be similar or identical to memory 124. For instance, the memory 208 may include one or multiple computer memory devices that are volatile or non-volatile. The memory 208 may be configured to store instruction sets that enable player 112 interaction with the gaming device 108, that enable game play at the gaming device 108, that enable head-to-head competitive wagering at the gaming device 108, that enable communications between gaming devices 108 in a competitive wagering session, and/or that enable coordination with the competitive wagering server 116. Examples of instruction sets that may be stored in the memory 308 include a game instruction set 220, a credit meter 224, a display presentation instruction set 228, a wagering session instruction set 232, and/or other instruction sets such as a ticket/voucher management instruction set and the like.

In some embodiments, the game instructions 220, when executed by the processor 204, may enable the gaming device 108 to facilitate one or more games of chance or skill and produce interactions between the player 112 and the game of chance or skill. In some embodiments, the game instructions 220 may include subroutines that present one or more graphics to the player 112 via the user interface 216, subroutines that calculate whether a particular game wager has resulted in a win or loss during the game of chance or skill, subroutines for determining payouts for the player 112 in the event of a win, subroutines for exchanging communications with a connected server (e.g., game management server, competitive wagering server 116, or the like), subroutines for enabling the player 112 to engage in a game using their mobile device 142, and any other subroutine or set of instructions that facilitate gameplay at or in association with the gaming device 108.

The credit meter 224 may correspond to a secure instruction set and/or data structure within the gaming device 108 that facilitates a tracking of activity at the gaming device 108. In some embodiments, the credit meter 224 may be used to store or log information related to various player 112 activities and events that occur at the gaming device 108. The types of information that may be maintained in the credit meter 224 include, without limitation, player information, available credit information, wager amount information, and other types of information that may or may not need to be recorded for purposes of accounting for wagers placed at the gaming device 108 and payouts made for a player 112 during a game of chance or skill played at the gaming device 108. In some embodiments, the credit meter 224 may be configured to track coin-in activity, coin-out activity, coin-drop activity, jackpot paid activity, bonus paid activity, credits applied activity, external bonus payout activity, ticket/voucher in activity, ticket/voucher out activity, timing of events that occur at the gaming device 108, and the like. In some embodiments, certain portions of the credit meter 224 may be updated in response to outcomes of a game of chance or skill played at the gaming device 108 and/or in response to occurrences or outcomes of events associated with competitive contests the player 112 bet on at the gaming device 108 as part of a head-to-head competitive wagering session. In some embodiments, the credit meter 224 may be updated depending upon whether the gaming device 108 is issuing a ticket/voucher, being used as a point of redemption for a ticket/voucher, and/or any other activity associated with a ticket/voucher. Some or all of the data within the credit meter 224 may be reported to the competitive wagering server 116, for example, if such data applies to a centrally-managed game and/or a status of a ticket/voucher. As an example, the number, value, and timing of wagers placed by a particular player 112 and payouts on such wagers may be reported to the competitive wagering server 116.

The display presentation instruction set 228, when executed by the processor 204, may enable the gaming device 108 to provide various display and/or auditory presentations for a game played on the gaming device 108 and/or a competitive wagering session application run on the gaming device 108. For instance, based on an event, or an outcome of an event, associated with a competitive contest the player 112 has bet on in a head-to-head competitive wagering session, the display presentation instruction set 228 may render one or more alerts, alarms, winning graphics, flashing lights, losing graphics, etc. In some embodiments, the display presentation instruction set 228 may alter a display presentation of the windows or elements rendered to a portion of a display device of the gaming device 108 based on the outcome of the head-to-head competitive wager. For the sake of example, when a player 112 bets on a particular sports team making the next kick, and the particular sports team fails to do so, the display presentation instruction set 228 may determine to alter a background image, windows, icons, and/or interactive elements rendered to the player's 112 gaming device 108. As another example, when a player 112 places a bet on a particular sports team, the display presentation instruction set 228 may render elements that reference the particular sports team (e.g., including logos, team colors, mascots, and/or other team relevant information). Additionally or alternatively, the display presentation instruction set 228 may instruct one or more speakers of the gaming device 108 to play sounds that indicate a status (e.g., a win, a loss, a push, etc.) of the wager made between gaming devices 108 in a head-to-head competitive wagering session. The display presentation instruction set 228 may provide one or more commands to the display controller 236 and the display device 238 to control a rendered output throughout a player's 112 head-to-head competitive wagering session at the gaming device 108.

The wagering instruction set 232, when executed by the processor 204, may enable the gaming device 108 to receive information from a betting system server 144, receive input from a player 112 (e.g., via the user interface 216, etc.) placing a bet against another player 112 on an outcome associated with an event in a competitive contest. The wagering session instruction set 232 may determine if the bet is placed in response to accepting a wagering invitation message generated and sent by another gaming device 108 in the head-to-head competitive wagering session. Additionally or alternatively, the wagering session instruction set 232 may determine if the bet is placed in response to a wagering invitation message being accepted by another gaming device 108 (e.g., associated with another player 112) in the head-to-head competitive wagering session. In this example, the wagering invitation message may be sent from a first gaming device 108 associated with a first player 112 to a second gaming device 108 associated with a second player 112. In some embodiments, the wagering session instruction set 232 may send a signal defining the bet placed to the betting system server 144 via the network interface 212 of the gaming device 108. The wagering instruction set 232 may command the one or more cameras 278 of the gaming device 108 to take at least one image of the player 112 placing the bet (e.g., to confirm that the player 112 is authorized to place the bet, etc.). In any event, the wagering instruction set 232 may work in conjunction with the display presentation instruction set 228 to render betting information (e.g., wagering opportunities, odds, etc.) obtained from the betting system server 144 to a display device 238 of the gaming device 108.

In some embodiments, a ticket/voucher management instruction set may be included in the memory 208 to work in conjunction with other instruction sets stored therein. Activities of the gaming device 108 related to ticket/voucher activity may be managed and reported by a ticket/voucher management instruction set. In some embodiments, when a ticket/voucher is redeemed at the gaming device 108 by the player 112, information associated with the ticket/voucher may be obtained by the ticket/voucher management instruction set and reported to the competitive wagering server 116 and/or the betting system server 144. Furthermore, the ticket/voucher management instruction set may be configured to update the credit meter 224 if a redeemed ticket/voucher is determined to be in a redeemable state and has a redeemable or redemption value associated therewith. In some embodiments, the credit meter 224 may be updated or incremented by the redeemable or redemption value of the ticket/voucher when redeemed. This information may be obtained directly from the ticket/voucher or may require some interactions with the competitive wagering server 116 prior to updating the credit meter 224.

The gaming device 108 may include one or more display devices 238 configured to render information, live video, communications windows, wagering interface windows, games, interactive elements, and/or other visual output to one or more display screens 248. The gaming device 108 may include one or more display controllers 236 configured to control an operation of the display device 238. This operation may include the control of input (e.g., player 112 input via the user interface 216, command input via the instruction sets in memory 208, combinations thereof, etc.), output (e.g., display, rendered images, visual game behavior, etc.) and/or other functions of the display device 238.

The display device 238 may one or more display screens 248 that are configured to selectively activate pixels and/or display elements to render one or more games, windows, indicators, interactive elements, icons, characters, lights, images, etc. Examples of the display screen 248 may include, but are in no way limited to, a liquid crystal display (LCD), a light-emitting diode (LED) display, an electroluminescent display (ELD), an organic LED (OLED) display, and/or some other two-dimensional and/or three-dimensional display. In some embodiments, the one or more display screens 248 may be separated into a main display and a secondary display. In a gaming device 108 context, the main display may correspond to a display arranged in a first viewing position of a player 112 and the secondary display may correspond to a display arranged in a second (e.g., higher) viewing position of the player 112. It is an aspect of the present disclosure that the gaming device 108 may include any number of display screens 248 in any arrangement or orientation (e.g., stacked, side-by-side, staggered, overlapped, angled, and/or combinations thereof). As described herein the display device 238 may be configured to render information in one or more discrete areas (e.g., windows, portions, zones, backgrounds, etc.) of the display screen 248 or superimposed in an area of the display screen 248.

The display device 238 may include a display driver 252, a power supply 256, an input/output 260, and/or other components 264 configured to enable operation of the display device 238. The display driver 252 may receive commands and/or other data provided by the processor 204 and one or more of the instruction sets in memory 208. In response to receiving the commands, the display driver 252 may be configured to generate the driving signals necessary to render the appropriate images to the display screen 248. The power supply 256 may provide electric power to the components of the display device 238. In some embodiments, the power supply 256 may include a transformer and/or other electronics that prevent overloading, condition power signals, and/or provide backup power to the display device 238. The input/output 260 may correspond to one or more connections for receiving or exchanging information and/or video from components of the gaming device 108. The input/output 260 may include an interconnection to the network interface 212. For example, the input/output 260 may include a high-definition multimedia interface (HDMI) input, Ethernet, composite video, component video, or other video connection. In some embodiments, the display device 238 may be configured to receive a live video feed via the input/output 260 and the network interface 212.

The cash-in device 240 may include a bill acceptor, a coin acceptor, a chip acceptor or reader, or the like. In some embodiments, the cash-in device may also include credit card reader hardware and/or software. The cash-out device 244, like the ticket issuance device 270, may operate and issue cash, coins, tokens, or chips based on an amount indicated within the credit meter 224. In some embodiments, the cash-out device 244 may include a coin tray or the like and counting hardware configured to count and distribute an appropriate amount of coins or tokens based on a player's 112 winnings or available credit within the credit meter 224.

Because the gaming device 108 may be used for the acceptance and issuance of tickets/vouchers, the gaming device 108 may be provided with appropriate hardware to facilitate such acceptance and issuance. Specifically, the gaming device 108 may be provided with a ticket acceptance device 270 that is configured to accept or scan physically-printed tickets/vouchers and extract appropriate information therefrom. In some embodiments, the ticket acceptance device 270 may include one or more machine vision devices (e.g., a camera, IR scanner, optical scanner, barcode scanner, etc.), a physical ticket acceptor, a shredder, etc. The ticket acceptance device 270 may be configured to accept physical tickets and/or electronic tickets without departing from the scope of the present disclosure. An electronic ticket/voucher may be accepted by scanning a one-dimensional barcode, two dimensional barcode, or other type of barcode or quick response (QR) code displayed by a player's 112 mobile device 142, for example. In one embodiment, an impersonal player ID may be present on the electronic ticket/voucher as part of the barcode, QR code, or other visible information on the electronic ticket/voucher.

The ticket issuance device 274 may be configured to print or provide physical tickets/vouchers to players 112. In some embodiments, the ticket issuance device 274 may be configured to issue a ticket/voucher consistent with an amount of credit available to a player 112, possibly as indicated within the credit meter 224.

The gaming device 108 may include at least one camera 278, or image capture device, that is configured to capture still and/or video images in proximity to the gaming device 108. The camera 278 may include, or be associated, with additional devices, such as light sources, flashes, infrared emitters, etc., to provide a clear image capture environment. As provided herein the camera 278 may be controlled by the processor 204 in conjunction with signals from the wagering instruction set 232 and/or other instruction sets in memory 208.

Figure 3A:
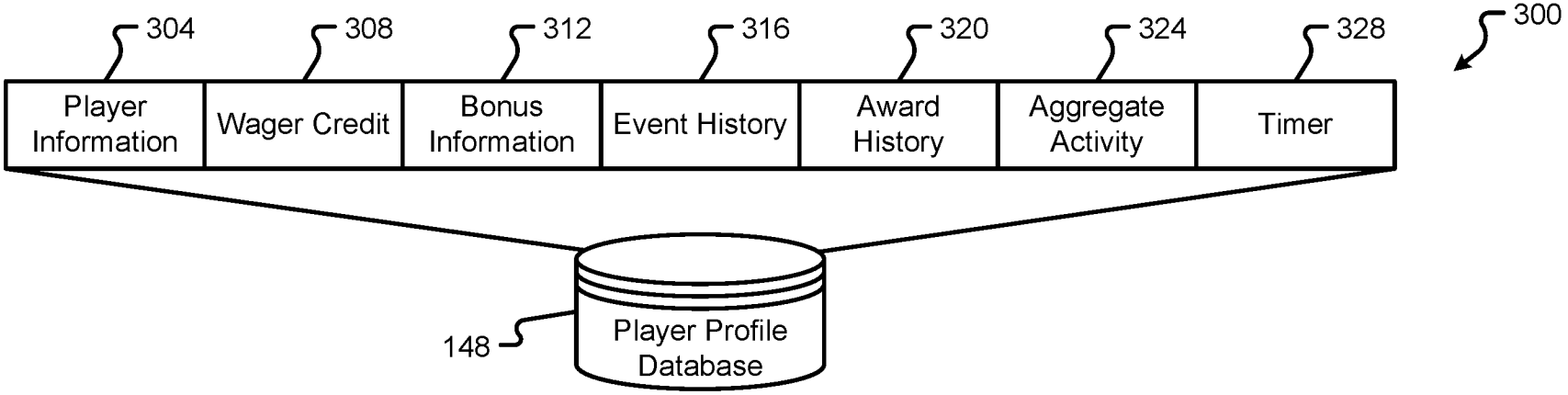
FIG. 3A is a block diagram depicting a first illustrative data structure used in accordance with embodiments of the present disclosure.
Figure 3B:
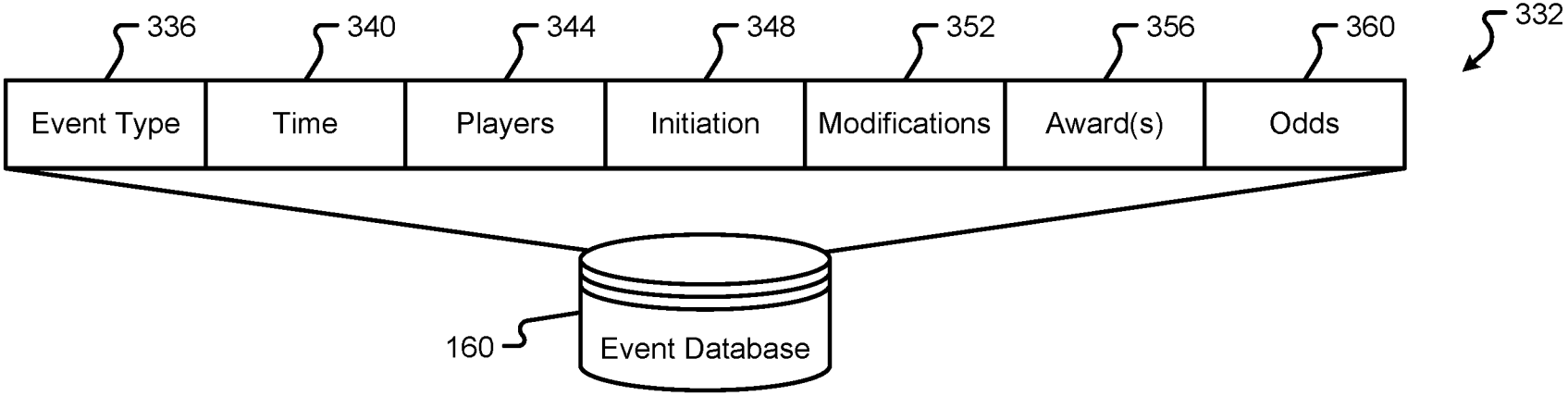
FIG. 3B is a block diagram depicting a second illustrative data structure used in accordance with embodiments of the present disclosure.

With reference now to FIGS. 3A and 3B, additional details of data structures that are useable in connection with managing player profiles and head-to-head competitive wagering behavior will be described in accordance with at least some embodiments of the present disclosure. It should be appreciated that the data structures depicted and described herein may be stored within a central database or may be distributed among a number of data storage nodes. Additionally or alternatively, some or all of the fields of the data structures may be maintained in devices of the competitive wagering system 100 such as the competitive wagering server 116, a betting system server 144, and/or a gaming device 108 (e.g., a mobile device 142, etc.) without departing from the scope of the present disclosure.

With reference initially to FIG. 3A, details of a data structure 300 that may be maintained as part of a player profile will be described in accordance with at least some embodiments of the present disclosure. The database 148 may be configured to store one or multiple data structures 300 that are used in connection with tracking player progress, wager history, and gaming activity. As a non-limiting example, the data structure 300 may be used to store wagers made, player history information, and the like. Even more specifically, the data structure 300 may include a plurality of data fields that include, for instance, player information field 304, a wager credit field 308, a bonus information field 312, an event history field 316, an award history field 320, an aggregate activity field 324, and a timer field 328.

The player information field 304 may be used to store any type of information that identifies a player 112 or a group of players 112. In some embodiments, the player information field 304 may store one or more of username information for a player 112, password information for a player account, player status information, accommodations associated with the player 112, and any other type of customer service management data that may be stored with respect to a player 112. Additionally or alternatively, the player information field 304 may store the player's 112 teams, avatars, sports, wagering groups, friends, contacts, preferred display layouts (e.g., number of portions, sizes of portions, colors, backgrounds, logos, etc.), and/or other preferences associated with the player 112. The data stored in the player information field 304 may include a favorite head-to-head competitive wagering contact list. This list may include the names or identifications of other players 112 who a player 112 prefers to wager against in the competitive wagering system 100.

The wager credit field 308 may be used to store data about a player's 112 available credit with a casino, betting system, or a plurality of casinos. For instance, the wager credit field 308 may store an electronic record of available credit in the player's 112 account and whether any restrictions are associated with such credit. The wager credit field 308 may further store information describing a player's 112 available credit over time, cash out events for the player 112, winning events for the player 112, and the like. In some embodiments, the wager credit field 308 may store information describing amounts won and/or lost from wagering in head-to-head competitive wagering sessions, amounts won and/or lost from playing a game of the gaming device 108, and/or other betting associated with the player 112.

The bonus information field 312 may be used to store information describing bonuses that have been paid to the player 112 or that are available to be paid in response to particular events occurring within the competitive wagering system 100. As a non-limiting example, the bonus information field 312 may be used to store electronic records for values of awards that are available to or have been paid to the player 112. Even more specifically, the bonus information field 312 may store values of awards that will be paid to the player 112 if a particular event occurs within a predetermined amount of time (as monitored by a timer value in the timer field 328) and to store a value of an award that will be paid to the player 112 if a plurality of events occur (e.g., winning a predetermined number of head-to-head competitive wagering sessions, etc.). In some embodiments, a value representing a predetermined award for a single event occurring may be less than a value representing a predetermined award for a plurality of events occurring. The bonus information field 312 may also be used to store probability information or odds associated with a particular event occurring or a plurality of events occurring. In some embodiments, the probability of a single event occurring within the competitive wagering system 100 may be greater than a probability of a plurality of events occurring, regardless of whether or not the plurality of events include the single event. In one embodiment, the bonus information field 312 may include information about which bonus opportunities a player 112 has registered for, been enrolled in, or automatically entered based on participating in one or more head-to-head competitive wagering sessions.

The event history field 316 may be used to store historical data for events that occur with respect to the player 112. Any event or plurality of events having an associated probability of occurrence or award associated therewith (e.g., based on the event being defined within the bonus information field 312) may have a corresponding entry within the event history field 316. For instance, the event history field 316 may store a definition of events and whether or not a particular event belongs to a plurality of events eligible for a jackpot bonus as discussed herein. Each event defined within the event history field 316 may further include an associated indicator to show whether the event has occurred or not and, if the event has occurred, when the event occurred. Some particular, but non-limiting events, may include a player's 112 outcome in a game of chance, a player's 112 outcome in a game of skill, an outcome of a bet placed by the player 112 at the gaming device 108 in a head-to-head competitive wagering session, whether a player 112 initiated a wagering invitation from a gaming device 108, whether a player 112 accepted a wagering invitation from another gaming device 108, whether a player 112 proposed a modification to a wagering invitation from another gaming device 108, whether a player 112 rejected a wagering invitation sent from another gaming device 108, a player 112 playing a particular game on a gaming device 108, a player 112 interacting with a mobile device 142, etc. The information stored in the event history field 316 may include a timestamp for each event, for example, defining when the event occurred. The timestamps may be used to determine timing associated with wagering in a head-to-head competitive wagering session, tracking bets made over time, organizing data, and/or the like. The information in the event history field 316 may be used to track a history of head-to-head competitive wagering sessions in which the player 112 participated.

The award history field 320 may store data related to awards, bonuses, mini-bonuses, score multipliers, jackpots, etc., granted to the player 112. The award history field 320 may also indicate when such awards were granted to the player 112, whether the awards have been redeemed, whether the awards are being funded by a game of chance or skill, a bet placed in a head-to-head competitive wagering session, a bet placed on an event associated with a competitive contest, a mini-bonus associated with an event, or a jackpot award associated with the player 112 completing a plurality of events. In some embodiments, the award history field 320 may comprise data regarding losses associated with the player 112. For instance, the award history field 320 may be used to track amounts lost, amounts won, and/or draws associated with one or more head-to-head competitive wagering sessions in which the player 112 participated. The information in the award history field 320 may be used by the competitive wagering server 116 and/or a gaming device 108 to determine win statistics associated with a particular player 112. For example, the competitive wagering server 116 may divide the number of wins associated with a player 112 participating in head-to-head competitive wagering sessions by the total number of head-to-head competitive wagering sessions the player 112 participated in for a particular event type, wager, or competitive contest to obtain a win quotient for the player 112. The win quotient may then be multiplied by 100 to obtain the win percentage for the player 112.

The aggregate activity field 324 may also be used to store event information related to a plurality of events that are to occur if the player 112 is to win a jackpot award or the like. Furthermore, the aggregate activity field 324 may store information related to head-to-head competitive wagers initiated by a player 112, head-to-head competitive wagers accepted by the player 112, head-to-head competitive wagers modified by the player 112, head-to-head competitive wagers rejected by the player 112, wagers placed on competitive contests, wagers placed on an event associated with a competitive contest, wagers in connection with trying to complete the plurality of activities and whether any portions of such wagers are being used to fund a jackpot pool (e.g., parlay pool, progressive pool, mystery progressive, etc.), associated with other players 112 competing in the same wagering event. The aggregate activity field 324 may store information related to a total number of wins and/or losses associated with bets made and/or accepted by a player 112 in head-to-head competitive wagering sessions over time. In some embodiments, the aggregate activity field 324 may include a rank of the player 112 based on wins and/or losses associated with head-to-head competitive wagering sessions. As can be appreciated, if the player 112 has more wins than other players 112 in the competitive wagering system 100 or the greatest number of wins among a group of players 112 in a number of head-to-head competitive wagering sessions, then that player 112 may have a first place, or top, ranking. Conversely, if the player 112 has fewer wins than other players 112 in the competitive wagering system 100 or the fewest number of wins among a group of players 112 in the number of head-to-head competitive wagering sessions, then that player 112 may have a last place, or bottom, ranking. Based on the number of wins and/or losses, the players 112 in the competitive wagering system 100 may be ranked between and including the first and last place rankings.

As discussed above, the timer field 328 may be used to store a timer value associated with tracking whether or not a particular player 112 has won a wager on, or completed, a particular event or a plurality of events within a predetermined amount of time. The value of the timer within the timer field 328 may count up, count down, or increment in any known way to track a passage of time. Alternatively or additionally, time may be measured by an occurrence of events within the competitive wagering system 100 rather than being measured absolutely. Specifically, the predetermined amount of time associated with determining whether a player 112 has completed an event or a plurality of events before some other player 112 within the system 100 has completed the same event or plurality of events. Thus, the timer does not necessarily have to count a passage of time with seconds and minutes, but rather may be counting a passage of time based on activities and events that occur within the system 100. Such information may be maintained within the timer field 328.

FIG. 3B shows details of another data structure 332 that may be used within the competitive wagering system 100 in accordance with at least some embodiments of the present disclosure. In some embodiments, the event data structure 332 may be stored in the player profile database 148, the event database 160, or an internal memory of the gaming device 108 and/or the competitive wagering server 116. In any event, the one or more event data structures 332 may be used in connection with providing a display and/or output presentation for a gaming device 108 based on an event associated with a competitive contest. In some embodiments, the data stored in the event data structure 332 may be stored for a plurality of different events, or event types. As a non-limiting example, the data structure 332 may be used to store an event type, a corresponding presentation output, and the like. Even more specifically, the data structure 332 may include a plurality of data fields that include, for instance, an event type field 336, a time field 340, a players field 344, an initiation field 348, a modifications field 352, an award field 356, and an odds field 360. It should be appreciated that the data structure 332 may have greater or fewer fields than depicted in FIG. 3B. In some embodiments, the event data structure 332 may store information associated with a particular head-to-head competitive wagering session or wagering invitation between at least two players 112 wagering against one another.

Upon initiating a wagering invitation, a player 112 may select a particular event type from a predetermined set of event types (e.g., a "canned" set of wagering opportunities, etc.) or define a custom event type (e.g., an event type that is not included in the "canned" set of wagering opportunities, etc.) for a competitive contest. As described herein, typical event types in competitive contests may include, but are in no way limited to, scores, positions, plays, penalties, errors, injuries, calls, reviews, outcomes, results, times associated therewith, and/or the like. In some embodiments, the players 112 participating in a head-to-head competitive wagering session may define the event as part of a wagering invitation. For instance, a first player 112 may create a wagering invitation comprising an invitation to wager on an event associated with a competitive contest. The wagering invitation may be sent as a message from a first gaming device associated with the first player 112 to a second gaming device associated with a different second player 112. In some embodiments, the wagering invitation message may include one or more of the fields associated with the event data structure 332. The competitive wagering server 116, upon receiving a wagering invitation message, may extract an event type from information included in the wagering invitation message (e.g., stored in the event type field 336, etc.) and then compare the extracted event type to a plurality of predetermined (e.g., canned) event types stored in the betting database 152 and/or the event database 160 for a match. Where a match does not exist, the competitive wagering server 116 may query the gaming device 108 associated with the player 112 for more information about the event type. In some instances, providing additional information about an undefined or unmatched event type may change it into a defined event type, which may then be used as part of the plurality of predetermined event types in future head-to-head competitive wagering sessions.

The event type field 336 may be used to store information that identifies the type of event subject to a wager between players 112 in a head-to-head competitive wagering session. As provided above, the event type may be selected from a plurality of predetermined event types or created as a new event type for competitive contests. In some embodiments, the event type may be classified or otherwise identified as a "defined" (e.g., predetermined event type) or an "undefined" event type (e.g., custom event type) in the event type field 336. Undefined event types may allow players 112 to bet against one another in the competitive wagering system 100 without the competitive wagering server 116 making automatic awards to the winning gaming device 108 as the occurrence of an undefined event type cannot be automatically confirmed. In this case, the awarding of the bet amount would rely on the honor of each player 112 (e.g., each making a selection of a specific winner via their respective gaming devices 108). In contrast, an event type that is classified or identified as "defined" may allow the competitive wagering server 116 to make automatic awards to the winning gaming device 108 in a head-to-head competitive wagering session. The type of the event included in the event type field 336 may be used, for example, by the wagering session instruction set 232 to determine details of a wager between players 112 in the competitive wagering system 100. In some embodiments, the information in the event type field 336 may be used by the competitive wagering server 116 to determine potential wagering opportunities, matching, and/or interactions for players 112 in a head-to-head competitive wagering session. Additionally or alternatively, the type of the event in the event type field 336 may be used by the display presentation instruction set 228 to determine whether the potential matches, interactions, and/or wagering opportunities should be rendered to the display device 238 of a gaming device 108 associated with a player 112. As provided above, event types may include, but are in no way limited to, scores, positions, plays, penalties, errors, injuries, calls, reviews, outcomes, results, times associated therewith, and/or the like.

The time field 340 may be used to store a time associated with a wagering invitation and/or time conditions associated with the event wagered on in the wagering invitation. In one embodiment, the time field 340 may include a timestamp associated with the creation of a wagering invitation. For instance, when a first player 112 creates a wagering invitation to wager on the outcome of an event associated with a competitive contest a timestamp and/or a date-stamp may be generated by the first player's 112 gaming device 108 that is stored in the time field 340 of the event data structure 332. Among other things, this timestamp may be used to organize (e.g., chronologically, etc.) wagers made between players 112 in the competitive wagering system 100. Additionally or alternatively, the time field 340 may be used to store a time associated with the occurrence of a particular event outcome. For instance, a first player 112 may initiate a wagering invitation that defines a particular event type or outcome (e.g., stored in the event type field 336) that must occur within a particular time period or based on a condition associated with the competitive contest. Examples of the time condition may include, but are in no way limited to, a next play, next down, a game result, score after a defined period in the game (e.g., half, first period, second period, first quarter, third quarter, etc.), a call by an official (e.g., referee, linesman, etc.). As another example the first player 112 may create the wager invitation and define that the event outcome must occur in a defined amount of time (e.g., by the three-minute mark of the game, in the next 40 seconds of the game, five minutes from now, etc.). In any event, the particular time period and/or conditional time may be stored in the time field 340. In some embodiments, the time in the time field 340 may be used by the competitive wagering server 116 to determine the conclusion of a wager made in the competitive wagering system 100.

The players field 344 may be used to store information about players 112 engaged in the head-to-head competitive wagering session and associated with the wagering invitation defined by the event data structure 332. For instance, the players field 344 may identify a first player 112 and a second player 112 wagering against one another as part of the head-to-head competitive wagering session. In addition to an identification of the players 112 participating in the head-to-head competitive wagering session, the players field 344 may include information about a wager position for each player 112 participating in the head-to-head competitive wagering session. For example, a first player 112 may take a wager position that a specific event will not occur in the next five minutes of game play, while a second player 112 takes the opposite wager position (e.g., that the specific event will occur in the next five minutes of game play). These wager positions may be stored with the respective player identifications in the players field 344. The competitive wagering server 116 may refer to the information in the players field 344 to determine a potential winner between the first and second players 112 upon the conclusion of the time associated with the wager.

The initiation field 348 may be used to store information about which player 112 initiated the wagering invitation in a head-to-head competitive wagering session. The initiator of a wagering invitation may be determined based on an identification of which gaming device 108 sent the wagering invitation message. The identification may use the player identification, player information, identification of the gaming device 108 associated with the player 112 (e.g., a hardware identification, media access control (MAC) address, IP address, or other unique serial number) that uniquely identifies one initiating player 112 from another in the competitive wagering system 100. The competitive wagering server 116 may use the data in the initiation field 348 to determine the number of wagering invitations initiated by players 112 in the competitive wagering system 100, which players 112 are the most active initiators of wager invitations (e.g., ranking the players 112 in the competitive wagering system 100, etc.), and/or determine a wagering behavior for the players 112 (e.g., encouraging wagering and competition by automatically matching initiators with non-initiators, and/or matching initiators with other initiators, etc.).

The modifications field 352 may be used to store information about whether a player 112 modified a wagering invitation in the head-to-head competitive wagering session. Additionally, the modifications field 352 may include information about which player 112 modified a wagering invitation. Similar to the initiation field 348, the player 112 who modified a wagering invitation may be determined based on an identification of which gaming device 108 sent a proposed modification in respond to receiving the wagering invitation message. The identification may use the player identification, player information, identification of the gaming device 108 associated with the player 112 (e.g., a hardware identification, MAC address, IP address, or other unique serial number) that uniquely identifies one player 112 from another player 112 in the competitive wagering system 100. The proposed modification may include any proposed change, or counteroffer, associated with the terms of the wager in the wagering invitation. For example, the proposed modification may request a change to the bet amount, the timing of the event, and/or the outcome of the event. In some embodiments, the proposed modification may alter or provide odds for the wager. In any event, the data in the modifications field 352 may be used by the display presentation instruction set 228 to determine whether to render a modification message or window to a display device 238 of a gaming device 108 in the competitive wagering system 100. In one embodiment, the data in the modifications field 352 may be used by the wagering session instruction set 232 in determining to send the proposed modification to the other gaming device 108 (e.g., via the competitive wagering server 116, etc.) in the competitive wagering system 100 for an acceptance decision.

The awards field 356 may be used to store information about awards associated with a particular event type in a competitive contest. Awards may include monetary awards, credits, additional game play opportunities, prizes, tickets, and the like. In some embodiments, the information in the award field 356 may be used to store data related to a specific bet amount associated with the wager in the wagering invitation. Any modifications to the bet amount (e.g., made in a proposed and accepted modification) may be updated in the award field 356. In some embodiments, as modifications are made to a wager by the players 112, the bet amounts may be recorded in the award field 356 along with a timestamp associated with the modification to the bet amount, etc. The information in the award field 356 may be used by the competitive wagering server 116 in determining an amount to award to the winner in a head-to-head competitive wagering session between two players 112. In addition, the information in the award field 356 may be used by the competitive wagering server 116 in determining an amount to decrement from the loser in the head-to-head competitive wagering session.

The odds field 360 may be used to store odds information associated with the particular event type (e.g., stored in the event type field 336). The odds may be based on predicted advantages, disadvantages, outcomes, and/or other information received from a betting system server 144. In some embodiments, the greater the odds (e.g., 10:1, 50:1, 100:1, 1000:1, etc.) associated with a particular event type, the greater the rewards (e.g., better chances of being enrolled in bonus opportunities, greater awards, and/or the like), or vice versa. It is an aspect of the present disclosure that the odds stored in the odds field 360 may be created by the players 112 wagering against one another in the head-to-head competitive wagering session. For instance, a first player 112 may create the wagering invitation to provide specific odds that an event type will occur in a specific time period. In this example, the opposing player 112 may accept the wager based on the odds offered by the first player 112. If the first player 112 loses the bet, then the payout to the opposing player 112 (e.g., from the first player 112) would be two-times the bet amount, minus a percentage or amount taken by a casino or other host of the competitive wagering system 100. However, if the first player 112 wins the bet, then the payout to the first player 112 (e.g., from the opposing player 112) would be the bet amount. Allowing the players 112 in the competitive wagering system 100 to set their own odds provides a more social wagering experience while removing the requirement for odds to be calculated (e.g., by a betting system server 144, etc.) in real-time, which can be processor and bandwidth intensive. Further, the wagering provided by the embodiments described herein does not require a casino or betting system server 144 to balance wagers to be profitable.

With reference now to FIGS. 4A-4D, representative images of a display screen 248 of a gaming device 108 exhibiting various composite presentations are shown in accordance with at least some embodiments of the present disclosure. The gaming device 108 may render any casino game, live video, and/or wagering information to the display area 400 of the display screen 248. In some embodiments, the display screen 248 may include a background configured to display a background image. The display area 400 may be separated into two or more display portions 406A-406F or areas. Although shown as including six different portions 406A-406F, it should be appreciated that the display area 400 may include greater or fewer portions, in similar or different proportions and/or sizes, than illustrated in FIG. 4A. In addition, one or more windows, display elements, or interactive features may cross over one or more of the portions 406A-406F illustrated in FIG. 4A. Stated another way, a window may at least partially fill a single portion 406A-406F of the display area 400 or an area defined by multiple portions 406A-406F of the display area 400. By way of example, the interactive wagering window 404 shown in FIG. 4B may substantially fill an area of the display area 400 defined by the first portion 406A, the second portion 406B, and the fourth portion 406D, together, while the live video window 408 is shown as substantially filling the third portion 406C of the display area 400. Continuing with the example presentation shown in FIG. 4B, the odds window 412 may substantially fill an area of the display area 400 defined by the fifth portion 406E and the sixth portion 406F together.

The display device 238 may be configured to render, via a competitive wagering session application (e.g., running on the gaming device 108 and/or the competitive wagering server 116), an interactive wagering window 404, a live video window 408, and/or an odds window 412. Additionally or alternatively, the display device 238 may be configured to render a player window 410 and/or a communications window 414 to the display area 400. As provided above, the display area 400 of the display screen 248 may be divided into separate, or discrete, areas or screen portions 406A-406F. It is an aspect of the present disclosure that the position of these areas may be moved, resized, minimized, superimposed, created, and/or removed, based at least on an event associated with a competitive contest the player 112 has bet on in a head-to-head competitive wagering session. The interactive wagering window 404 may correspond to a wagering interface window that allows a player 112 to initiate, manage, and/or track wagering invitations and wagers in the competitive wagering system 100. In some embodiments, the interactive wagering window 404 may receive information from the betting system server 144, the competitive wagering server 116, and/or other devices in the competitive wagering system 100. The live video window 408 may provide a gaming interface for a player 112 to play a game associated with the gaming device 108 (e.g., provided by the gaming device 108 and/or a gaming server, etc.) and/or view live video of a competitive contest (e.g., received from a contest video server, etc.). The odds window 412 may include information received from the betting system server 144, betting database 152, and/or the competitive wagering server 116.

In some embodiments, the windows rendered to the display area 400 of the display device 238 may all relate to a particular head-to-head competitive wagering session. For example, the interactive wagering window 404 may display wager invitations and information associated with a wager on an event (e.g., between two players 112) of a competitive contest that is playing in real-time and shown in the live video window 408, while displaying the odds associated with events in the competitive contest displayed in the odds window 412. Additional details regarding the competitive wagering session application providing the user interface elements (e.g., windows, selection buttons, etc.) rendered to the display area 400 of the display device 238 will be described in conjunction with FIGS. 4B-4D.

Figure 4A:
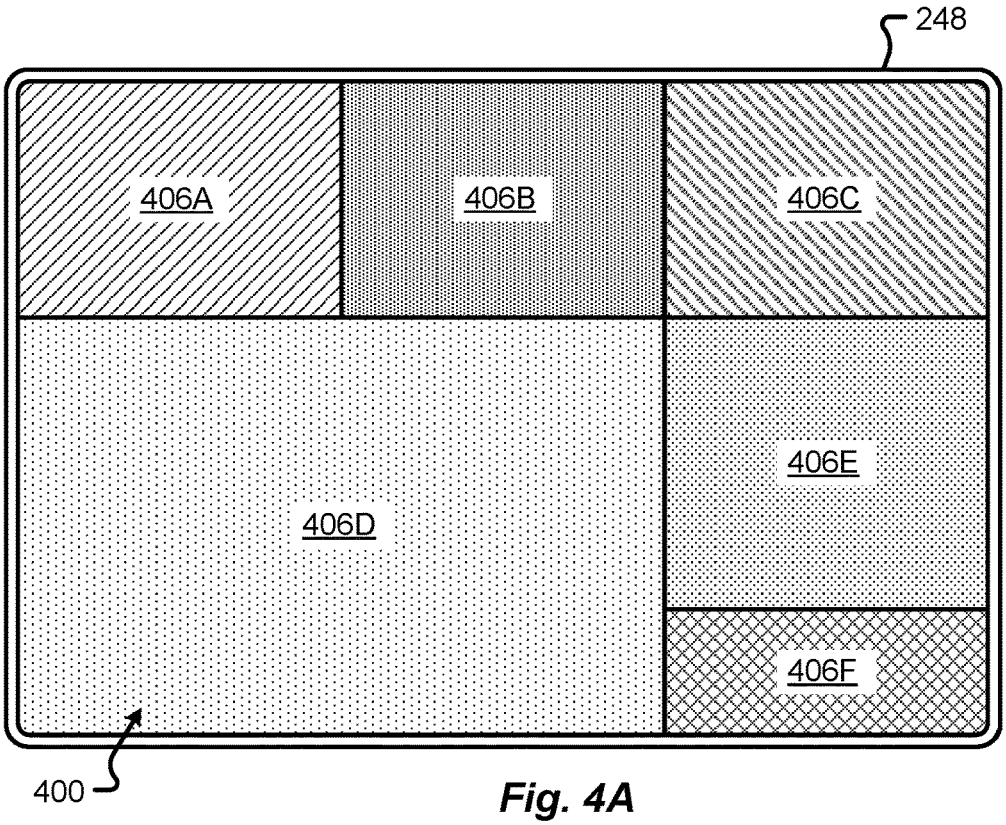
FIG. 4A is a schematic diagram of a screen of a gaming device in a segmented presentation in accordance with embodiments of the present disclosure.

FIG. 4A shows a representative image of a display screen 248 of a gaming device 108 in a first competitive wagering presentation in accordance with embodiments of the present disclosure. The display screen 248 in the first competitive wagering presentation includes a display area 400 configured to render an interactive wagering window 404, a live video window 408, and an odds window 412, optionally over a background image. In the first competitive wagering presentation, the interactive wagering window 404 is rendered to a first portion 406A, second portion 406B, and a fourth portion 406D of the display area 400, the live video window 408 is rendered to a third portion 406C, and the odds window 412 is rendered to the fifth portion 406E and the sixth portion 406F of the display area 400.

Figure 4B:
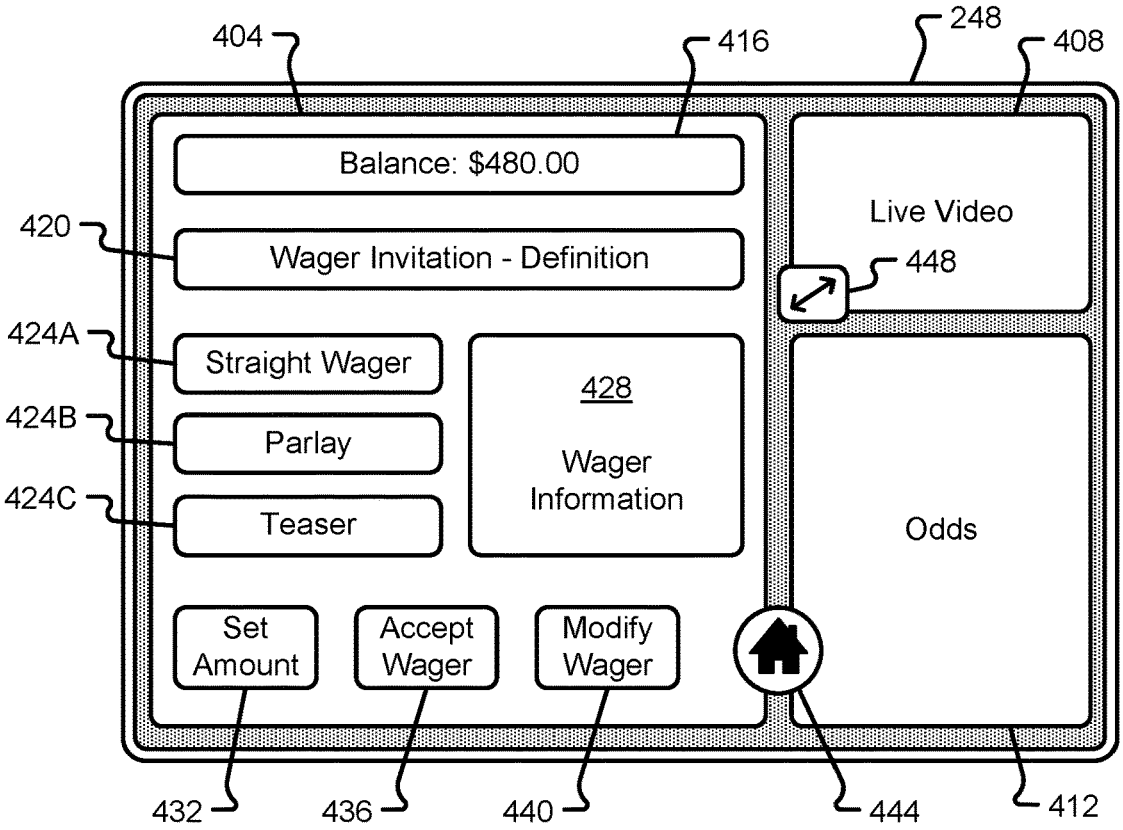
FIG. 4B is a representative image of a screen of a gaming device in a first competitive wagering presentation in accordance with embodiments of the present disclosure.

In addition to the separate windows 404, 408, 412, the display area 400 may include interface elements that manipulate or alter a size and/or position of the windows and/or a navigation between applications running on the gaming device 108. For example, the display area 400 includes a navigation button 444 shown spanning over a portion of the interactive wagering window 404 and the odds window 412. Although shown in this location, it should be appreciated that the navigation button 444 may be rendered to any portion or combination of portions of the display area 400. The navigation button 444 may provide a player 112 with the ability to navigate between applications, close windows, move windows off screen, and/or otherwise move among programs running on the gaming device 108. In some embodiments, the display area 400 may include one or more window manipulation buttons 448. As shown in FIG. 4B, the window manipulation button 448 is illustrated in a corner of the live video window 408. Although shown in this location, it should be appreciated that the window manipulation button 448 may be rendered to any portion or combination of portions of the display area 400. In some embodiments, the window manipulation button 448 may cause a particular window to expand, contract, move, or otherwise resize. Additionally or alternatively, the window manipulation button 448 may cause one window to swap positions with another window rendered to the display area 400. For instance, as shown in FIG. 4B, a player 112 may select the window manipulation button 448 to swap the interactive wagering window 404 with the live video window 408 such that the content associated with the live video window 408 is moved and resized (e.g., expanded) to be shown in the first portion 406A, second portion 406B, and fourth portion 406D of the display area 400 together (e.g., taking the place of the interactive wagering window 404). In this example, the content of the live video window 408 may move and resize (e.g., shrink) into the third portion 406C (e.g., taking the place of the live video window 408).

It is an aspect of the present disclosure that one or more portions 406A-406F or windows 404, 408, 412 in the display area 400 may include data that is generated by the gaming device 108 or data that is received over at least one communication ports of the network interface 212. For example, content in first portion 406A may have data generated from the gaming device 108 itself or may present some data received over one port (e.g., a first communications port) of the network interface 212, whereas another portion 406B of the display area 400 may have data generated from a remote source and may be received over a different port (e.g., a second communications port). Additionally or alternatively, both portions 406A, 406B may have content received over the same network interface 212, but at different times and/or on different communication channels (even if received over the same port of the network interface 212).

The interactive wagering window 404 is shown rendered to the first portion 406A, second portion 406B, and the fourth portion 406D of the display area 400. As shown in FIG. 4B, the interactive wagering window 404 may include information for a player 112 to engage in, initiate, manage, and/or track wagers in the competitive wagering system 100. The interactive wagering window 404 may include a balance amount indicator 416, a wager detail area 420, a number of interactive wagering elements 424A-424C, a wager information area 428, a set amount selection button 432, an acceptance selection button 436, and a modification selection button 440. The balance amount indicator 416 may be configured to render a credit amount in a player account associated with the player 112. The wager detail area 420 may include information about a received wagering invitation in a head-to-head competitive wagering session. In some embodiments, the wager detail area 420 may list conditions of the wager including, but in no way limited to, a bet amount, an event, an outcome associated with the event, a wagering position of the opposing player 112 in the head-to-head competitive wagering, and/or any other wager specific information. The player 112 may respond to the received wagering invitation by selecting one of the interactive elements 424A-424C defining a wager type, setting an amount (e.g., if no amount is defined) via the set amount selection button 432, accepting the invitation to wager via the acceptance selection button 436, and/or modifying the terms of the wager (e.g., bet amount, etc.) via the modification selection button 440. In some embodiments, selection of one or more of these elements/buttons may cause another window to be rendered to the display area 400. The interactive wagering window 404 may include a wager information area 428 that lists wagers made by the player 112, current wagers in which the player 112 is participating, and/or statistics associated with wagering by the player 112 in the competitive wagering system 100. In some embodiments, the wager information area 428 may include a number of betting opportunities in the form of a list or presentation of events and/or competitive contests on which a player 112 may place a wager against another player 112 in the competitive wagering system 100. For instance, a player 112 may interact with the wager information area 428 via a user interface 216 to select a particular betting opportunity rendered to the interactive wagering window 404.

The live video window 408 may be configured to render a live video of a competitive contest to a third portion 406C of the display area 400. In some embodiments, the live video may be of a competitive contest associated with the wager made between the players 112 in the competitive wagering system 100. The live video window 408 may stream live video about the competitive contest (e.g., a live football game, a live race, a basketball game, a baseball game, etc.) in real time or in near real time (e.g., as the competitive contest is underway or being played). In one embodiment, the interactive wagering window 404 may change position or swap positions with the live video window 408. While the competitive contest is underway, the players 112 participating in a head-to-head competitive wagering session may wager on outcomes of events associated with the competitive contest, in real time.

In some embodiments, the live video window 408 may be replaced with an interactive gaming window configured to render an interactive casino game to the display screen 248. Examples of casino games that can be rendered to the interactive gaming window, or other window of the display area 400, may include, but are in no way limited to, poker, blackjack, craps, roulette, slots, bingo, keno, baccarat, dice games, and the like.

The odds window 412, in FIG. 4B, is shown rendered to an area of the display area 400 spanning the fifth portion 406E and the sixth portion 406F. The odds window 412 may include odds associated with different betting opportunities. The odds may be in the form of a list or other presentation that relates a particular event with the odds (e.g., a predicted likelihood, etc.) associated with that event occurring in the competitive contest. In some embodiments, the odds window 412 may render the odds from the odds field 360 that are part of a wager. As provided above, these odds may be received from the betting system server 144 and/or a player 112 who may set the odds associated with a particular wager.

Figure 4C:
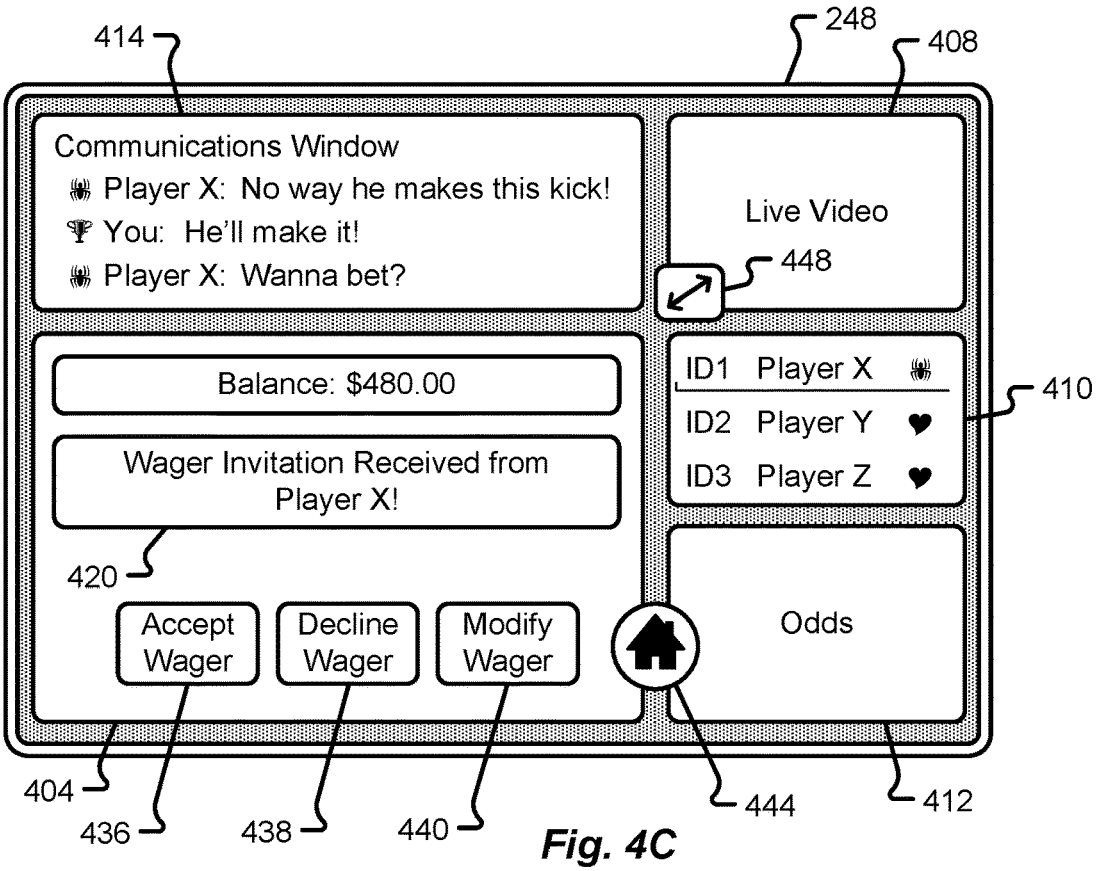
FIG. 4C is a representative image of a screen of a gaming device in a second competitive wagering presentation in accordance with embodiments of the present disclosure.
Figure 4D:
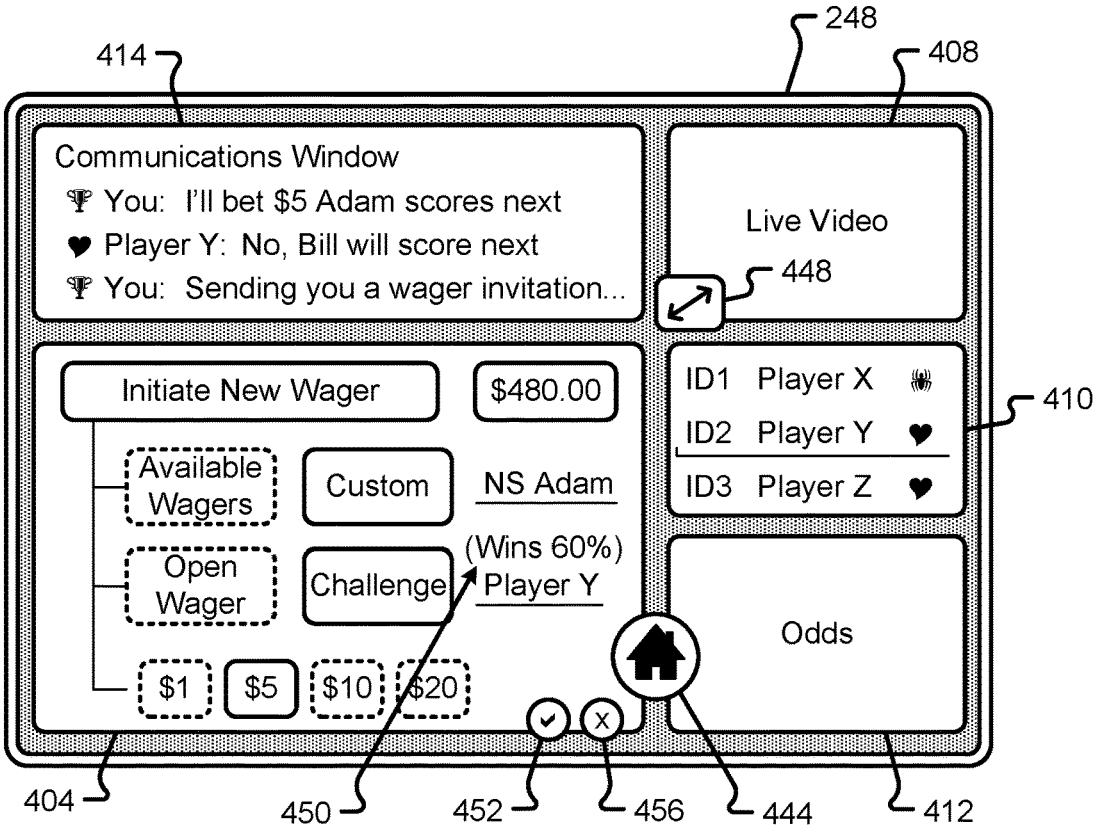
FIG. 4D is a representative image of a screen of a gaming device in a third competitive wagering presentation in accordance with embodiments of the present disclosure.

FIGS. 4C and 4D show representative images rendered by a display screen 248 of a gaming device 108 comprising various social interaction windows 410, 414 associated with the competitive wagering system 100 and/or a head-to-head competitive wagering session. In some embodiments, the display area 400 may include one or more of a player window 410 and a communications window 414. As shown in FIGS. 4C and 4D, the player window 410 is rendered to the fourth portion 406D of the display area 400 and the communications window 414 is rendered to both the first portion 406A and the second portion 406B of the display area 400.

The player window 410 may comprise information about a number of players 112 who have registered with the competitive wagering system 100, who are participating in head-to-head competitive wagering sessions, who are matched to the player 112, and/or who are known friends and/or wagering opponents of the player 112 associated with the gaming device 108. The players 112 in the player window 410 may be ordered in a list or other presentation based on their name, the preferences of the player 112 associated with the gaming device, and/or based on a match made by the competitive wagering server 116. In some embodiments, the players 112 in the player window 410 may be ranked based on awards associated with past head-to-head competitive wagering sessions. As shown in FIGS. 4C and 4D, the information for each player 112 in the player window 410 may include a player identification (e.g., ID1, ID2, ID3, etc.), a name (e.g., Player X, Player Y, Player Z, etc.), and an icon identifying a relationship between the player 112 and the players 112 listed in the player window 410. In FIG. 4C, Player X is shown having a "spider" icon, which may identify Player X as being a favorite wagering opponent (e.g., a frenemy, etc.), while Player Y and Player Z may be shown with a "heart" icon, which may identify the players 112 as friends of the player 112. Friends may support the same team or teams, personally know the player 112, or be part of a league or group the player 112 is a part of. Frenemies may support teams that oppose the teams the player 112 supports but may offer a competitive and fun wagering environment for head-to-head competitive wagering sessions.

In some embodiments, the competitive wagering session application may provide an ability for players 112 in the competitive wagering system 100 to communicate with one another via, for example, a communications window 414. As shown in FIG. 4C, communications between the gaming device 108 of the player 112 and the gaming device 108 of Player X are rendered to the communications window 414. The communications exchanged between gaming devices 108 associated with the players 112 participating in a head-to-head competitive wagering session may be in the form of text messages, multimedia messages, and/or the like. In the example illustrated in FIG. 4C, Player X initiated and sent a wagering invitation inviting the player 112 to wager on whether a certain team will make a kick in the next play (e.g., in real time). The information, or terms, associated with the wagering invitation initiated by Player X may be presented in wager detail area 420 of the interactive wagering window 404. In response, the player 112 may accept the wager by selecting the acceptance selection button 436, decline the wager by selecting the denial selection button 438, and/or modify the wager by selecting the modification selection button 440 in the interactive wagering window 404. In addition to the identification of Player X in the communications window 414, the player window 410 may provide an indication (e.g., an underscore, highlight, or other affect) associated with the players 112 listed that the communication includes a specific player 112 (e.g., the name of Player X is underscored in the player window 410). As provided herein, the player 112 may modify the terms of the wager by selecting the modification selection button 440 in response to receiving the invitation to wager on an outcome of an event associated with a competitive contest. These terms may include, but are in no way limited to, the bet amount, the timing of the wager or the occurrence of the outcome of the event, and/or other details related to the wager.

As shown in FIG. 4D the player 112 is communicating with a friend (e.g., Player Y, identified by the underscore in the player window 410) via the text exchange in the communications window 414. In the communication, the friends discuss a potential wagering opportunity. In some embodiments, the competitive wagering session application may automatically prompt the player 112 with a wagering invitation initiation interface rendered to the interactive wagering window 404. This prompt may be based on an analysis of the communications exchanged. In one embodiment, the player 112 may initiate a new wagering invitation by selecting the opposing player 112 from the player window 410 and picking a "bet now" popup or option. In any event, the interactive wagering window 404 may render an "initiate new wager" window that provides a number of options from which the player 112 may select in creating a new wagering invitation. The new wagering invitation may be sent as a message (e.g., across the communication network 104) to the opposing player 112. The options may include canned event types under an "available wagers" selection field, or a custom event type (e.g., next scorer is Adam). Additionally or alternatively, the interactive wagering window 404 may include an "open wager" option, which allows the player 112 to hold the wager open to all players 112 in the competitive wagering system 100 interested in the competitive contest, or a "challenge" option that allows a player 112 to select another player 112 from the player window 410. In the example presentation shown in FIG. 4D, the player 112 has selected the "challenge" option and picked Player Y. In some embodiments, the wagering statistics of a player 112 may be shown in one or more of the windows 404, 410, 414, for example, in a player statistics identifier 450. These statistics may provide information corresponding to a win or loss percentage of a challenging player 112. The statistics shown in the player statistics identifier 450 may also be shown when an invitation to wager is received by the gaming device 108 of the player 112. The interactive wagering window 404 may provide the player 112 with a number of "bet amounts" from which to choose in creating the wagering invitation. In FIG. 4D, the player 112 may select from a $1, $5, $10, and $20 bet amount, although embodiments of the present disclosure should not be so limited. These amounts may be based on historical wagering information associated with one or more players 112 in the competitive wagering system 100. In one embodiment, the player 112 may enter a custom bet amount for the wagering invitation. Once the terms are completed, the player 112 may select the send button 452 to send the wagering invitation to the second player (e.g., Player Y). If the player 112 does not wish to initiate the wager, the player 112 may select the cancel button 456 to close the "initiate new wager" interaction of the interactive wagering window 404. In some embodiments, once the player 112 selects the send button 452, the wagering invitation may be sent as a message from the gaming device 108 associated with the player 112 to the competitive wagering server 116. The competitive wagering server 116 may then send information from the wagering invitation message, across the communication network 104, to the gaming device 108 of the second player 112 for an acceptance decision. Details of the operation of the competitive wagering system 100 will be described in conjunction with FIGS. 5-7.

Figure 5:
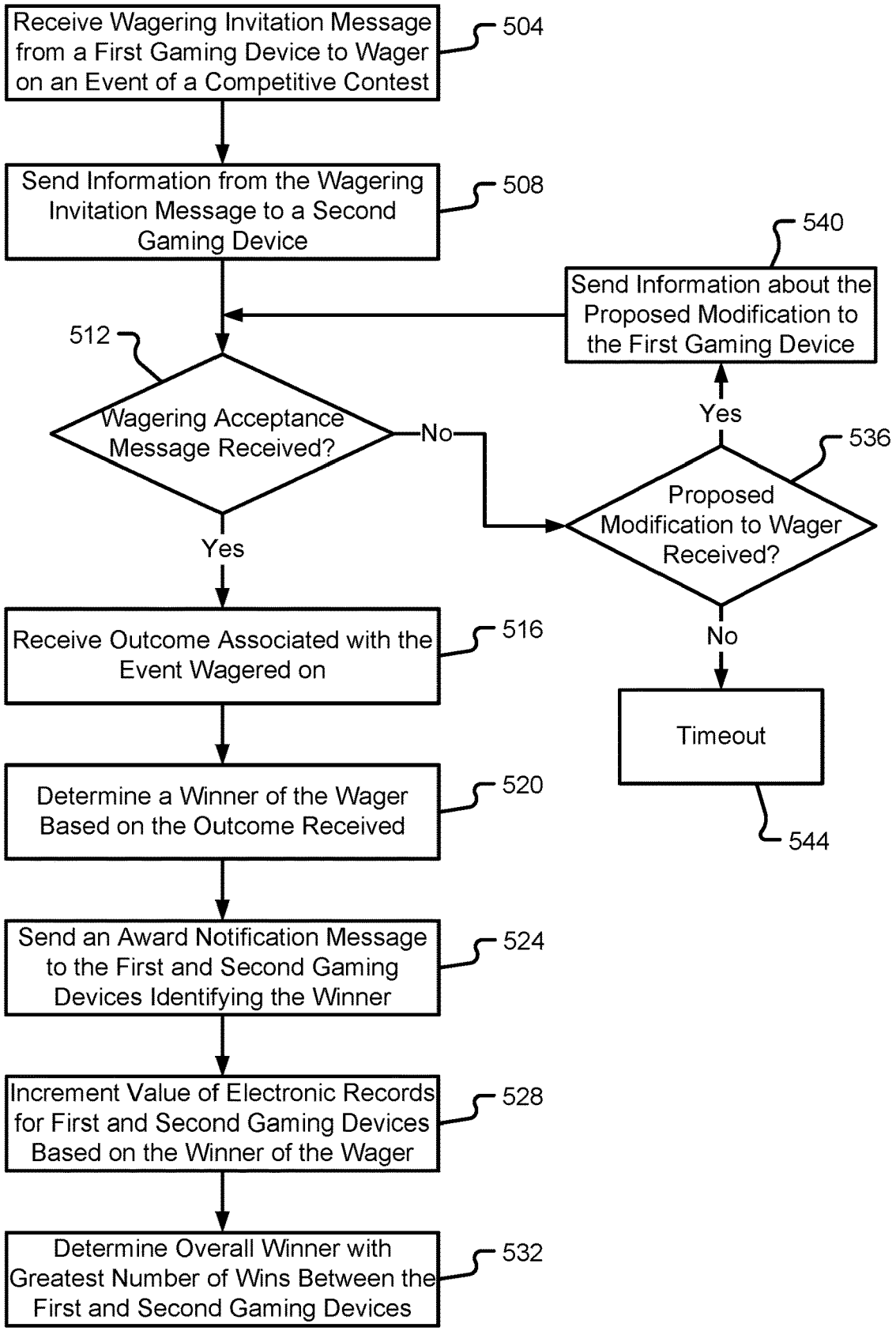
FIG. 5 is a flow diagram depicting a method of providing head-to-head wagering between gaming devices in accordance with embodiments of the present disclosure.

With reference now to FIG. 5, a flow diagram depicting a method of providing head-to-head wagering between gaming devices 108 in a competitive wagering system 100 is shown in accordance with embodiments of the present disclosure. The methods described herein may be run as a set of instructions on a gaming device 108, a competitive wagering server 116, and/or some other server of the competitive wagering system 100. In some embodiments, the set of instructions may be part of a competitive wagering session application installed on one or more of the gaming devices 108, competitive wagering server 116, and/or other server that manages head-to-head competitive wagering between gaming devices 108 in the competitive wagering system 100 in real time. In any event, the method begins by receiving a wagering invitation message from a first gaming device 108 to wager on an event of a competitive contest (step 504). The wagering invitation message may be sent while the competitive contest is playing, in real time, and before the event occurs. The wagering invitation message may comprise an invitation directed to a second gaming device 108 to wager on the event. In particular, the invitation to wager may define an outcome associated with the event and an amount for the wager. As provided above, the wagering invitation may be initiated by player 112 in the competitive wagering system 100 who wishes to participate in a head-to-head competitive wagering session with another player 112 in the competitive wagering system 100.

Next, the method continues by sending information from the wagering invitation message to the second gaming device 108 in the competitive wagering system 100 (step 508). In some embodiments, the competitive wagering server 116 may extract the information from the wagering invitation message, determine the terms of the wager associated therewith, and send the information (e.g., in the form of a message) to the second gaming device 108 across the communication network 104. In one embodiment, the competitive wagering server 116 may forward the wagering invitation message to the second gaming device 108. In some embodiments, the information sent by the competitive wagering server 116 may cause the second gaming device 108 to render details of the invitation to an interactive wagering window 404. Upon receiving the wagering invitation message, the competitive wagering server 116 may determine an amount or percentage of the bet amount associated with the wager to retain in the event of a payout.

The method may proceed by determining whether a wagering acceptance message is received from the second gaming device 108 that accepts the invitation to wager on the event (step 512). As provided above, in response to receiving the information from the wagering invitation message, the second player 112 associated with the second gaming device 108 may accept, decline, or modify (e.g., propose a modification to) the wager via the user interface elements of the interactive wagering window 404. When the second player 112 selects the acceptance selection button 436 or selects some other interactive element of the user interface 216 associated with the display device 238, the wagering acceptance message may be sent from the second gaming device 108. In some embodiments, the wagering acceptance message may be sent from the second gaming device 108 to the competitive wagering server 116.

In some embodiments, the method may proceed when a wagering acceptance message is not received from the second gaming device 108 by determining whether a proposed modification to the wager is received (step 536). If no wagering acceptance message or proposed modification is received within a specific time, the method may timeout at step 544 and the wagering invitation may be terminated or otherwise canceled. The timeout may occur based on a failed response by the second gaming device 108 within a specific time. For example, as the head-to-head competitive wagering session allows wagering between players 112 in real time, the wager invitation and acceptance message must be received before the event occurs. If the event is in the process of occurring, or has occurred, the method may cause the ability for the wager invitation to be accepted to timeout. In this instance, no wager would be made. In some embodiments, the second player 112 may wish to alter the terms of the wager (e.g., bet amount, etc.) and propose a modification to do so. In this case, the method may proceed when the competitive wagering server 116 receives the proposed modification from the second gaming device 108 (e.g., in the form of a message sent across the communication network 104, etc.). In some embodiments, the second player 112 may initiate a proposed modification by selecting the modification selection button 440 associated with the interactive wagering window 404. In response to receiving the proposed modification from the second gaming device 108, the competitive wagering server 116 may send (e.g., across the communication network 104) information about the proposed modification to the first gaming device 108 for acceptance, rejection, or further modification (step 540). The method may then repeat at step 512.

The method continues by receiving an outcome associated with the event wagered on between the first player 112 and the second player 112 competing against one another in the head-to-head competitive wagering session (step 516). The outcome may correspond to the occurrence, or failure of an occurrence, of the event wagered on in the amount of time identified in the wagering invitation. In one embodiment, determination of the outcome may be made by the event data server 156. In this embodiment, when the event is determined to have occurred, the outcome of the event may be sent (e.g., as a message across the communication network 104, etc.) to the competitive wagering server 116.

Based on the outcome associated with the event wagered on, the method may proceed by determining a winner between the first player 112 and the second player 112 (step 520). As provided above, the wagering position of each player 112 may be defined in the wagering invitation and/or the event data structure 332. The winner may be the player 112 having the correct wagering position identifying the outcome of the event. In some cases, the players 112 may draw, in which case no winner can be identified. In this case, the players 112 may be provided with an option to continue wagering via their respective gaming device 108.

The method proceeds by sending an award notification message to the first gaming device 108 and the second gaming device 108 identifying the winner of the wager (step 524). The award notification may be rendered to one or more portions 406A-406F of the display area 400 of each gaming device 108. In some embodiments, the award notification may be accompanied by a graphic that reorders players 112 in a leaderboard or ranked list based on the identified winner.

The method continues by incrementing the value of electronic records for the first gaming device 108 and the second gaming device 108 based on the winner of the wager (step 528). Incrementing the value of the electronic record may include incrementing an award amount in a player account associated with the winning player 112 (e.g., increasing the award amount for the winner), incrementing a loss amount in a player account associated with the losing player 112 (e.g., decreasing the award amount for the loser) in the head-to-head competitive wagering session. In some embodiments, a casino or other host of the competitive wagering server 116 may take a percentage, or portion, of the award amount as payment for facilitating the competitive wagering system 100. This portion may correspond to the determined amount, or percentage, of the bet amount associated with the wager that was determined by the competitive wagering server 116 after receiving the wagering invitation message in step 508. In any event, the competitive wagering server 116 may increment a retained bet amount in a host account reflecting the portion taken by the casino and/or other host of the competitive wagering server 116.

Once a number of wagers have been made between players 112 competitive wagering session, the method may continue by determining the overall winner having the greatest number of wins (or fewest number of losses) between the first gaming device 108 and the second gaming device 108 in the head-to-head competitive wagering session (step 532). In some embodiments, the overall winner may be based on the greatest number of wins after a competitive contest has conclude, during a portion of a competitive contest (e.g., a first half, quarter, period, etc.), a total number of wins for a day of competitive contests wagered on, and/or a total number of head-to-head competitive wagering sessions completed over time. The overall winner selected from the first and second gaming devices 108 competing in the competitive wagering system 100 may be displayed and ranked above the other players 112 in a leaderboard. In some embodiments, the leaderboard may be rendered to a portion of the display area 400 of the gaming device 108.

Figure 6:
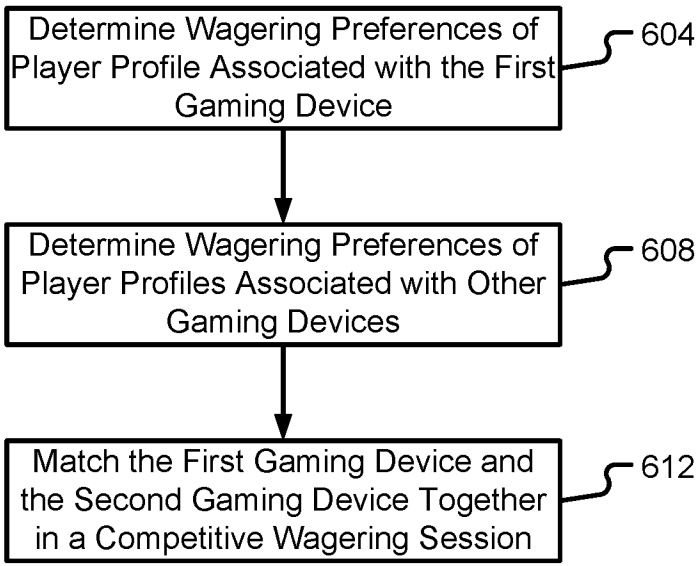
FIG. 6 is a flow diagram depicting a method of determining matches between gaming devices in a competitive wagering session in accordance with embodiments of the present disclosure.

FIG. 6 is a flow diagram depicting a method of determining matches between gaming devices 108 in a head-to-head competitive wagering session in accordance with embodiments of the present disclosure. The method begins by determining the wagering preferences of a player profile associated with a first gaming device 108 (step 604). In some embodiments, the competitive wagering server 116 executing the session management instruction set 132 may access the player information data structure 300 of a player 112 in the competitive wagering system 100. The competitive wagering server 116 may access the player information field 304 to determine preferences of the player 112. For instance, a player 112 may have a friends list or known contacts the player 112 prefers to wager against in head-to-head competitive wagering sessions stored in the player information field 304. Based on the information at least in this field 304 and/or other fields 308-328 of the player information data structure 300, the competitive wagering server 116 may determine a wagering behavior for the player 112 associated with the gaming device 108.

Next, the method continues by searching the wagering preferences of other players 112 registered with the competitive wagering system 100. Similar to step 604, the competitive wagering server 116 may access the fields 304-328 of the player information data structure 300 for each other player 112 in the competitive wagering system 100. Using the wagering behavior and/or other preferences for the player 112 associated with the first gaming device 108, the competitive wagering server 116 may determine whether a predetermined number of preferences and/or other behaviors of the player 112 match the preferences and/or other behaviors of at least one other player 112 in the competitive wagering system 100.

When a match exists between the first gaming device 108 associated with a first player 112 and a second gaming device associated with a second player 112, the method may continue by matching the first gaming device 108 and the second gaming device 108 together in a head-to-head competitive wagering session (step 612). In some embodiments, this match may include the competitive wagering server 116 pairing the first gaming device 108 and the second gaming device 108 in a head-to-head competitive wagering session where communications are enabled between the gaming devices 108, the players 112 associated with the gaming devices 108 are listed in a player window 410 rendered to a display area 400 of the display device 238 of each respective gaming device 108, and head-to-head competitive wagering is enabled between the two gaming devices 108. In one embodiment, a notification may be rendered to the interactive wagering window 404 of the first gaming device 108 that a second player 112 associated with a second gaming device 108 would like to wager on a game in real time, or vice versa. In some embodiments, the matches provided herein may be made automatically and without human input via the competitive wagering server 116.

Figure 7:
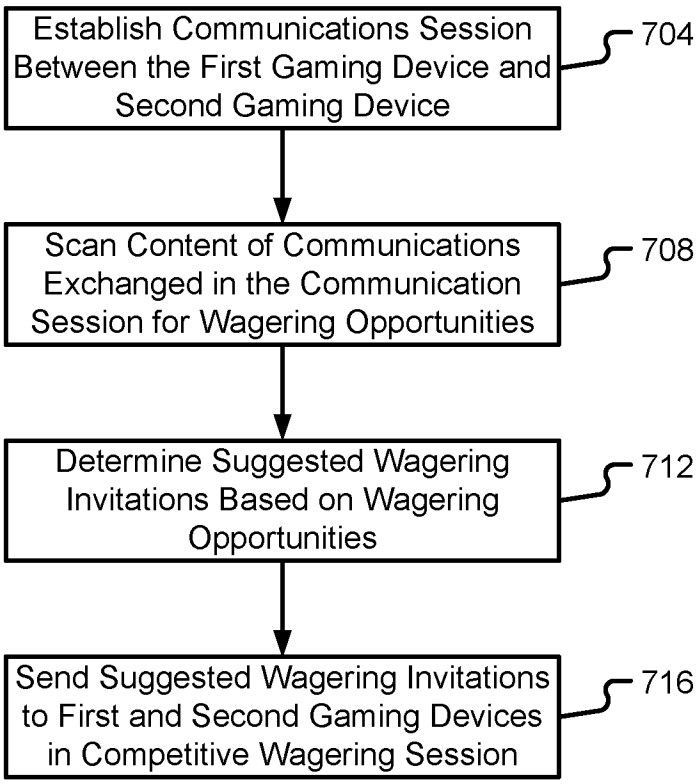
FIG. 7 is a flow diagram depicting a method of determining suggested wagering invitations to be sent to gaming devices in a communication session in accordance with embodiments of the present disclosure.

Referring now to FIG. 7, a flow diagram depicting a method of determining suggested wagering invitations to be sent to gaming devices 108 in a competitive wagering system 100 is shown in accordance with embodiments of the present disclosure. The method may begin by establishing a communications session between a first gaming device 108 and a second gaming device 108 in the competitive wagering system 100 (step 704). The communications session may include providing an ability for the first gaming device 108 to communicate with the second gaming device 108 via text, messaging, and/or voice over a communication network 104. In some embodiments, the communications between devices 108 may be enabled via a competitive wagering session application running on each gaming device 108 and/or on the competitive wagering server 116. The communications may be rendered to a communications window 414 of a display device 238 of a gaming device 108, as described in conjunction with FIGS. 4C and 4D. In one embodiment, establishing a communications session may include a user interface input (e.g., mouse click, touch, etc.) provided by a player 112 selecting an icon or identifier associated with a particular player 112 in the player window 410.

While the players 112 exchange communications via their respective gaming devices 108 in the communications session, the method may continue by scanning the content of the communications for potential wagering opportunities (step 708). In one embodiment, as messages are sent from one gaming device 108 to the other gaming device 108, the competitive wagering server 116 may perform a keyword, or phrase, search of the messages for wagering language. For instance, the messages may include words and phrases such as, but in no way limited to, "next play," "bet," "wager," "score," "dollars," "odds," "on his game," "she's on fire," "they're unbeatable," "streak," "challenge," combinations thereof, and the like. In some embodiments, the scan may include the competitive wagering server 116 searching for pre-wagering phrases that may be learned by, or taught to, the competitive wagering server 116 based on historical data (e.g., past pre-wagering communications, where certain phrases were exchanged between devices 108 prior to the initiation of a wagering invitation, etc.). In any event, this wagering language may indicate that potential wagering opportunities exist between the players 112 in the head-to-head competitive wagering session.

The method continues by determining wagering invitations based on the potential wagering opportunities (step 712). In some embodiments, the competitive wagering server 116 may search additional content of the communications for a subject of the wagering opportunity. This additional content may depend on a proximity of the additional content relative to the words and phrases that indicate a wagering opportunity exists. For instance, the competitive wagering server 116 may determine that a first player 112 used the phrase "I'll bet you he doesn't," indicating a wagering opportunity exists, and prior to that phrase being used the other player 112 may have stated that "Adam will make it." Based on this data, the competitive wagering server 116 may cause a wagering invitation initiation interface (e.g., similar to the interface shown in the interactive wagering window 404 of FIG. 4D) to be rendered to the gaming device 108 associated with the first player 112 and/or the other player 112 (step 716). The wagering invitation initiation interface may include prepopulated wager data extracted from the communication including the subject of the bet. Continuing the example above, the prepopulated wager data presented to the first player 112 may read as follows: "Adam will NOT make the field goal," while the prepopulated wager data presented to the second player 112 for initiating a wagering invitation may read as follows: "Adam WILL make the field goal." In some embodiments, the competitive wagering server 116 may suggest a bet amount and/or allow the players 112 to define their own bet amount for the wagering invitation. In the event that the competitive wagering server 116 suggests a bet amount, the suggestion may be based on historical betting data, content of the communications, and/or minimum bet amounts associated with the head-to-head competitive wagering session.

In addition to the embodiments described above, the present disclosure offers a number of additional benefits and features. Because the competitive wagering system 100 described herein provides an electronic interface method and system for making real-time head-to-head competitive wagers between players 112, the need for balancing bets by determining prices odds associated with an event in a short amount of time is unnecessary. As can be appreciated, allowing the odds to be set by the players 112, if at all, in a real-time head-to-head competitive wager, removes the requirement for processor intensive calculations (e.g., making real-time odds calculations, etc.) to be made while still allowing a casino or host of the competitive wagering server 116 to take an amount of the wager. Further, the ability to provide communication between players 112 and allow the players 112 to challenge one another (e.g., via wagering invitations, etc.) while a game is playing, in real time, provides an enhanced social experience over other systems where players 112 bet against a sportsbook or racebook.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A system, comprising:

a communications interface that enables communications with a first gaming device and a second gaming device;

a processor coupled to the communications interface; and a memory coupled with and readable by the processor and storing therein instructions that, when executed by the processor, cause the processor to:

receive, via the communications interface and from the first gaming device, a wagering invitation message comprising an invitation to wager on an event associated with a competitive contest, wherein the invitation to wager defines an outcome associated with the event and an amount for the wager;

send, via the communications interface, information from the wagering invitation message to the second gaming device;

receive, via the communications interface and from the second gaming device, a wagering acceptance message comprising an acceptance of the invitation to wager on the event;

determine, based on whether the outcome associated with the event occurred, a winner of the wager; and send, via the communications interface, an award notification message to the first gaming device and the second gaming device that provides an indication of the winner of the wager.

2. The system of claim 1, wherein the event is selected at the first gaming device and wherein the wagering invitation message is received at the communications interface during the competitive contest.

3. The system of claim 2, wherein the instructions further cause the processor to:

receive, via the communications interface, a proposed modification by the second gaming device to the amount for the wager; and send, via the communications interface, information about the proposed modification to the first gaming device.

4. The system of claim 3, wherein the instructions further cause the processor to:

receive, via the communications interface and from the first gaming device, a modification acceptance message accepting the proposed modification by the second gaming device.

5. The system of claim 2, wherein the instructions further cause the processor to:

determine, based on a player profile associated with each of the first gaming device and the second gaming device, to match the first gaming device and second gaming device together in a competitive wagering session.

6. The system of claim 5, wherein the instructions further cause the processor to:

send, via the communications interface, a wagering opportunity message to the first gaming device and the second gaming device comprising a plurality of events associated with the competitive contest that are selectable by the first gaming device and the second gaming device during the competitive wagering session.

7. The system of claim 2, wherein the instructions further cause the processor to:

increment a value of an electronic record defining a win of the wager for the first gaming device when the outcome associated with the event occurs during the competitive contest; and increment a value of an electronic record defining a loss of the wager for the second gaming device when the outcome associated with the event occurs during the competitive contest.

8. The system of claim 7, wherein the instructions further cause the processor to:

receive, via the communications interface during a competitive wagering session between the first gaming device and the second gaming device, a personal message exchanged between the first gaming device and the second gaming device corresponding to the wager; and determine, after a plurality of different events associated with the competitive contest have been won by at least the first gaming device and the second gaming device, an overall winner with a greater number of wins.

9. A method for providing head-to-head wagering between gaming devices, comprising:

receiving, via a communications interface and from a first gaming device, a wagering invitation message comprising an invitation to wager on an event associated with a competitive contest, wherein the invitation to wager defines an outcome associated with the event and an amount for the wager;

sending, via the communications interface, information from the wagering invitation message to a second gaming device;

receiving, via the communications interface and from the second gaming device, a wagering acceptance message comprising an acceptance of the invitation to wager on the event;

determining, via a processor and based on whether the outcome associated with the event occurred, a winner of the wager; and sending, via the communications interface, an award notification message to the first gaming device and the second gaming device that provides an indication of the winner of the wager.

10. The method of claim 9, wherein the event is selected by the first gaming device and wherein the wagering invitation message is received during the competitive contest.

11. The method of claim 10, further comprising:

receiving, at the processor, a proposed modification by the second gaming device to the amount for the wager; and sending, via the communications interface, information about the proposed modification to the first gaming device.

12. The method of claim 11, further comprising:

receiving, via the communications interface and from the first gaming device, a modification acceptance message accepting the proposed modification by the second gaming device.

13. The method of claim 10, further comprising:

determining, via the processor and based on a player profile associated with each of the first gaming device and the second gaming device, to match the first gaming device and second gaming device together in a competitive wagering session.

14. The method of claim 13, further comprising:

sending, via the communications interface, a wagering opportunity message to the first gaming device and the second gaming device comprising a plurality of events associated with the competitive contest that are selectable by the first gaming device and the second gaming device during the competitive wagering session.

15. The method of claim 10, further comprising:

incrementing, via the processor, a value of an electronic record defining a win of the wager for the first gaming device when the outcome associated with the event occurs during the competitive contest; and incrementing, via the processor, a value of an electronic record defining a loss of the wager for the second gaming device when the outcome associated with the event occurs during the competitive contest.

16. The method of claim 15, further comprising:

determining, via the processor and after a plurality of different events associated with the competitive contest have been won by at least the first gaming device and the second gaming device, an overall winner with a greatest number of wins between the first gaming device and the second gaming device.

17. A gaming device, comprising:

a display device;

a communications interface;

a processor coupled to the display device and the communications interface; and a memory coupled with and readable by the processor and storing therein instructions that, when executed by the processor, cause the processor to:

render a competitive contest to a first portion of the display device;

receive, via the communications interface, a wagering invitation message created by a first gaming device comprising an invitation to wager on an event associated with a competitive contest against the first gaming device;

render information from the wagering invitation message to a second portion of the display device, the information defining a wager of whether an outcome associated with the event will occur during the competitive contest and an amount for the wager;

receive input from a user interacting with the gaming device accepting the wager of whether the outcome associated with the event will occur during the competitive contest and the amount for the wager; and send, via the communications interface, a signal comprising information defining acceptance of the wager on behalf of the user along with a time at which the input was received from the user.

18. The gaming device of claim 17, wherein the instructions further cause the processor to:

receive, via the communications interface, a signal indicative of whether the outcome associated with the event occurred during the competitive contest; and render information describing the outcome to the display device.

19. The gaming device of claim 18, further comprising:

a first live video source connected to the communications interface, wherein the set of instructions further causes the processor to receive, via the first live video source, a first live video feed of the competitive contest and render the first live video feed to the second portion of the display device.

20. The gaming device of claim 19, further comprising:

a second live video source connected to the communications interface, wherein the set of instructions further causes the processor to receive, via the second live video source, a second live video feed of a second competitive contest and render the second live video feed to a third portion of the display device while the first live video feed is rendered to the second portion of the display device.

* * * * *